US007512534B2

(12) United States Patent
Chu

(10) Patent No.: US 7,512,534 B2
(45) Date of Patent: Mar. 31, 2009

(54) OPTIMIZED WINDOWS AND METHODS THEREFORE FOR GRADIENT-DESCENT BASED WINDOW OPTIMIZATION FOR LINEAR PREDICTION ANALYSIS IN THE ITU-T G.723.1 SPEECH CODING STANDARD

(75) Inventor: Wai C. Chu, San Jose, CA (US)

(73) Assignee: NTT DoCoMo, Inc., Tokyo (JP)

( * ) Notice: Subject to any disclaimer, the term of this patent is extended or adjusted under 35 U.S.C. 154(b) by 91 days.

(21) Appl. No.: 11/595,415

(22) Filed: Nov. 9, 2006

(65) Prior Publication Data

US 2007/0061136 A1 Mar. 15, 2007

Related U.S. Application Data

(62) Division of application No. 10/322,909, filed on Dec. 17, 2002.

(51) Int. Cl.
*G10L 19/14* (2006.01)
*G10L 19/00* (2006.01)

(52) U.S. Cl. ..... 704/211; 704/219; 704/224

(58) Field of Classification Search ..... None
See application file for complete search history.

(56) References Cited

U.S. PATENT DOCUMENTS 5,357,594 A 10/1994 Fielder
5,394,473 A 2/1995 Davidson
5,848,391 A 12/1998 Bosi et al.
6,226,608 B1 5/2001 Fielder et al.
6,311,154 B1 10/2001 Gersho et al.
6,622,120 B1 * 9/2003 Yoon et al. ..... 704/222
6,748,363 B1 6/2004 Lueck et al.

OTHER PUBLICATIONS

"Implementing the Levinson-Durbin Algorithm on the SCI40" by Corneliu Margina and Bogdan Costinescu, Nov. 2001.

K.I. Siddiqui, Prof. Dr. N.M. Sheikh, H. Raza, and M.A. Farooq Alam, Bahauddin, "Real-Time Implementation of ITU-T's G.723.1 Dual Rate Speech Code for Multimedia Communications Transmittings t 5.3 and 6.3 kbits/s on Trimedia's TM-1000 VLIW DSP CPU", Proc. of IEEE 4th International Multitopics Conference, Dec. 2001, Lahore, Pakistan.

(Continued)

*Primary Examiner*—David R Hudspeth
*Assistant Examiner*—Brian L Albertalli
(74) *Attorney, Agent, or Firm*—Blakely, Sokoloff, Taylor & Zafman LLP

(57) ABSTRACT

Primary and alternate optimization procedures are used to improve the ITU-T G.723.1 speech coding standard (the "Standard") by replacing the Hamming window of the Standard with an optimized window, with two windows, or with two windows and an additional performance of an autocorrelation method. When two windows replace the Hamming window, at least one of which is an optimized window, generally the first is used to determine optimized unquantized LP coefficients which are used to define an optimized perceptual weighting filter, and the second is used to determine optimized unquantized LP coefficients which are used to determine optimized synthesis coefficients. Optimized windows created using the primary and alternate optimization procedures and used in the Standard yield improvements in the objective and subjective quality of synthesized speech produced by the Standard. The improved Standard, methods, and widow can all be implemented as computer readable software code.

53 Claims, 17 Drawing Sheets

OTHER PUBLICATIONS

Fu-Kun Chen, Jar-Ferr Yang, and Yu-Pin Lin, Complexity Scalability for ACELP and MP-MLQ Speech Coders, IEICE Trans Inf. & Syst. vol. E85-D, No. Jan. 2002, pp. 255-263.

International Telecommuncation Union, "Dual-Rate Speech Coder for Multimedia Communications Transmitting at 5.3 and 6.3 kbits/s", ITU-T Recommendation G.723, Mar. 1996.

* cited by examiner

| Length | Rectangular window | | | | Optimized window | | | |
|---|---|---|---|---|---|---|---|---|
| | Training | | Testing | | Training | | Testing | |
| | SPG | PEP | SPG | PEP | SPG | PEP | SPG | PEP |
| 120 | 8.968 | 24359 | 8.800 | 25953 | 9.563 (+6.64%) | 22198 (-8.87%) | 9.400 (+6.82%) | 22879 (-11.8%) |
| 140 | 8.963 | 24156 | 8.845 | 25767 | 9.507 (+6.07%) | 22297 (-7.70%) | 9.408 (+6.38%) | 23249 (-9.77%) |
| 160 | 8.952 | 24094 | 8.871 | 25319 | 9.455 (+5.62%) | 22459 (-6.79%) | 9.338 (+5.27%) | 23304 (-7.96%) |
| 200 | 8.932 | 24131 | 8.823 | 25972 | 9.372 (+4.93%) | 22769 (-5.64%) | 9.284 (+5.22%) | 23874 (-8.08%) |
| 240 | 8.947 | 24198 | 8.845 | 25975 | 9.333 (+4.32%) | 23092 (-4.57%) | 9.186 (+3.85%) | 24254 (-6.63%) |
| 300 | 8.923 | 24604 | 8.799 | 26341 | 9.241 (+3.57%) | 23608 (-4.05%) | 9.128 (+3.74%) | 25019 (-5.02%) |

| Bit-rate | Data | Coder 1 | Coder 2 | Coder 3 | Coder 4 | Coder 5 |
|---|---|---|---|---|---|---|
| 5.3 kbit/s | Training | 3.69 | 3.71 (+0.54%) | 3.72 (+0.81%) | 3.74 (+1.4%) | 3.73 (+1.1%) |
| | Testing | 3.62 | 3.62 | 3.67 (+1.4%) | 3.63 (+0.28%) | 3.65 (+0.83%) |
| 6.3 kbit/s | Training | 3.80 | 3.80 | 3.81 (+0.26%) | 3.82 (+0.53%) | 3.82 (+0.53%) |
| | Testing | 3.74 | 3.75 (+0.27%) | 3.77 (+0.80%) | 3.76 (+0.53%) | 3.77 (+0.80%) |

FIG. 16

| File | Coder1 | Coder2 | Coder3 | Coder4 | Coder5 |
|---|---|---|---|---|---|
| f1 | 3.228 | 3.231 | 3.242 | 3.237 | 3.228 |
| f2 | 3.374 | 3.344 | 3.311 | 3.341 | 3.403 |
| f3 | 3.259 | 3.239 | 3.302 | 3.346 | 3.340 |
| f4 | 3.079 | 3.112 | 3.086 | 3.144 | 3.131 |
| m1 | 3.640 | 3.613 | 3.626 | 3.665 | 3.651 |
| m2 | 3.504 | 3.475 | 3.619 | 3.584 | 3.617 |
| m3 | 3.623 | 3.614 | 3.673 | 3.713 | 3.719 |
| m4 | 3.566 | 3.554 | 3.612 | 3.585 | 3.610 |
| **Average** | **3.409** | **3.398** (-0.31%) | **3.434** (+0.71%) | **3.452** (+1.3%) | **3.462** (+1.6%) |

FIG. 17

OPTIMIZED WINDOWS AND METHODS THEREFORE FOR GRADIENT-DESCENT BASED WINDOW OPTIMIZATION FOR LINEAR PREDICTION ANALYSIS IN THE ITU-T G.723.1 SPEECH CODING STANDARD

This is a divisional of application Ser. No. 10/322,909, filed on Dec. 17, 2002, entitled "Optimized Windows and Methods Therefore for Gradient-Descent Based Window Optimization for Linear Prediction Analysis in the ITU-T G.723.1 Speech Coding Standard," and assigned to the corporate assignee of the present invention and incorporated herein by reference.

BACKGROUND

Speech analysis involves obtaining characteristics of a speech signal for use in speech-enabled applications, such as speech synthesis, speech recognition, speaker verification and identification, and enhancement of speech signal quality. Speech analysis is particularly important to speech coding systems.

Speech coding refers to the techniques and methodologies for efficient digital representation of speech and is generally divided into two types, waveform coding systems and model-based coding systems. Waveform coding systems are concerned with preserving the waveform of the original speech signal. One example of a waveform coding system is the direct sampling system which directly samples a sound at high bit rates ("direct sampling systems"). Direct sampling systems are typically preferred when quality reproduction is especially important. However, direct sampling systems require a large bandwidth and memory capacity. A more efficient example of waveform coding is pulse code modulation.

In contrast, model-based speech coding systems are concerned with analyzing and representing the speech signal as the output of a model for speech production. This model is generally parametric and includes parameters that preserve the perceptual qualities and not necessarily the waveform of the speech signal. Known model-based speech coding systems use a mathematical model of the human speech production mechanism referred to as the source-filter model.

The source-filter model models a speech signal as the air flow generated from the lungs (an "excitation signal"), filtered with the resonances in the cavities of the vocal tract, such as the glottis, mouth, tongue, nasal cavities and lips (a "synthesis filter"). The excitation signal acts as an input signal to the filter similarly to the way the lungs produce air flow to the vocal tract. Model-based speech coding systems using the source-filter model generally determine and code the parameters of the source-filter model. These model parameters generally include the parameters of the filter. The model parameters are determined for successive short time intervals or frames (e.g., 10 to 30 ms analysis frames), during which the model parameters are assumed to remain fixed or unchanged. However, it is also assumed that the parameters will change with each successive time interval to produce varying sounds.

The parameters of the model are generally determined through analysis of the original speech signal. Because the synthesis filter generally includes a polynomial equation including several coefficients to represent the various shapes of the vocal tract, determining the parameters of the filter generally includes determining the coefficients of the polynomial equation (the "filter coefficients"). Once the synthesis filter coefficients have been obtained, the excitation signal can be determined by filtering the original speech signal with a second filter that is the inverse of the synthesis filter (an "analysis filter").

One method for determining the coefficients of the synthesis filter is through the use of linear predictive analysis ("LPA") techniques. LPA is a time-domain technique based on the concept that during a successive short time interval or frame "N," each sample of a speech signal ("speech signal sample" or "s[n]") is predictable through a linear combination of samples from the past s[n−k] together with the excitation signal u[n]. The speech signal sample s[n] can be expressed by the following equation:

$$s[n] = \sum_{k=1}^{M} a_k s[n-k] + Gu[n] \tag{1}$$

where G is a gain term representing the loudness over a frame with a duration of about 10 ms, M is the order of the polynomial (the "prediction order"), and $a_k$ are the filter coefficients which are also referred to as the "LP coefficients." The filter is therefore a function of the past speech samples s[n] and is represented in the z-domain by the formula:

$$H[z]=G/A[z] \tag{2}$$

A[z] is an M order polynomial given by:

$$A[z] = 1 + \sum_{k=1}^{M} a_k z^{-k} \tag{3}$$

The order of the polynomial A[z] can vary depending on the particular application, but a 10th order polynomial is commonly used with an 8 kHz sampling rate.

The LP coefficients $a_1 \ldots a_M$ are computed by analyzing the actual speech signal s[n]. The LP coefficients are approximated as the coefficients of a filter used to reproduce s[n] (the "synthesis filter"). The synthesis filter uses the same LP coefficients as the analysis filter and produces a synthesized version of the speech signal. The synthesized version of the speech signal may be estimated by a predicted value of the speech signal $\tilde{s}[n]$. $\tilde{s}[n]$ is defined according to the formula:

$$\tilde{s}[n] = -\sum_{k=1}^{M} a_k s[n-k] \tag{4}$$

Because s[n] and $\tilde{s}[n]$ are not exactly the same, there will be an error associated with the predicted speech signal $\tilde{s}[n]$ for each sample n referred to as the prediction error $e_p[n]$, which is defined by the equation:

$$e_p[n] = s[n] - \tilde{s}[n] = s[n] + \sum_{k=1}^{M} a_k s[n-k] \tag{5}$$

where the sum of all the prediction errors defines the total prediction error $E_p$:

$$E_p=\Sigma e_p^2[k] \tag{6}$$

where the sum is taken over the entire speech signal. The LP coefficients $a_1 \ldots a_M$ are generally determined so that the total prediction error $E_p$ is minimized (the "optimum LP coefficients").

One common method for determining the optimum LP coefficients is the autocorrelation method. The basic procedure consists of signal windowing, autocorrelation calculation, and solving the normal equation leading to the optimum LP coefficients. Windowing consists of breaking down the speech signal into frames or intervals that are sufficiently small so that it is reasonable to assume that the optimum LP coefficients will remain constant throughout each frame. During analysis, the optimum LP coefficients are determined for each frame. These frames are known as the analysis intervals or analysis frames. The LP coefficients obtained through analysis are then used for synthesis or prediction inside frames known as synthesis intervals. However, in practice, the analysis and synthesis intervals might not be the same.

When windowing is used, assuming for simplicity a rectangular window sequence of unity height including window samples (also referred to as "windows") w[n], the total prediction error Ep in a given frame or interval may be expressed as:

$$E_p = \sum_{k=n1}^{n2} e_p^2[k] \tag{7}$$

where n1 and n2 are the indexes corresponding to the beginning and ending samples of the window sequence and define the synthesis frame.

Once the speech signal samples s[n] are isolated into frames, the optimum LP coefficients can be found through autocorrelation calculation and solving the normal equation. To minimize the total prediction error, the values chosen for the LP coefficients must cause the derivative of the total prediction error with respect to each LP coefficients to equal or approach zero. Therefore, the partial derivative of the total prediction error is taken with respect to each of the LP coefficients, producing a set of M equations. Fortunately, these equations can be used to relate the minimum total prediction error to an autocorrelation function:

$$E_p = R_p[0] - \sum_{i=1}^{M} a_i R_p[k] \tag{8}$$

where M is the prediction order and $R_p(k)$ is an autocorrelation function for a given time-lag l which is expressed by:

$$R[l] = \sum_{k=l}^{N-1} w[k]s[k]w[k-l]s[k-l] \tag{9}$$

where s[k] are speech signal sample, w[k] are the window samples that together form a plurality of window sequences each of length N (in number of samples) and s[k−l] and w[k−l] are the input signal samples and the window samples lagged by l. It is assumed that w[n] may be greater than zero only from k=0 to N−1. Because the minimum total prediction error can be expressed as an equation in the form Ra=b (assuming that $R_p[\mathbf{0}]$ is separately calculated), the Levinson-Durbin algorithm may be used to solve the normal equation in order to determine for the optimum LP coefficients.

Many factors affect the minimum total prediction error including the shape of the window in the time domain. Generally, the window sequences adopted by coding standards have a shape that includes tapered-ends so that the amplitudes are low at the beginning and end of the window sequences with a peak amplitude located in-between. These windows are described by simple formulas and their selection inspired by the application in which they will be used. Generally, known methods for choosing the shape of the window are heuristic. There is no deterministic method for determining the optimum window shape.

For example, the speech coding system defined by the ITU-T G.723.1 speech coding standard (the "G.723.1 standard") uses a Hamming window ("standard Hamming window") but has no method for determining whether the Hamming window will yield the optimum LP coefficients. The G.723.1 standard is designed to compress toll quality speech (at 8000 samples/second) for applications including the voice-over-internet-protocol ("VoIP") and the voice component of video conferencing. It is an analysis-by-synthesis dual rate speech coder that uses different quantizing techniques to quantize the excitation signal depending on the data rate (ITU, "Dual Rate Speech Coder for Multimedia Communications Transmitting at 5.2 and 6.2 kbits/-ITU-T Recommendations G.723.1, 1996, which is incorporated herein by reference). A multi-pulse maximum likelihood quantizer ("MLQ") is used to quantize the excitation signals for the high bit rate of 6.3 kbs and an algebraic-code-excited-linear-predictor ("ACELP") is used to quantize the excitation signal for the low bit rate of 5.3 kbps.

The particular LPA used by the G.723.1 standard (the "LPA process") is shown in FIG. 1 and indicated by reference number 10. The LPA process 10 operates on frames of 240 samples or 30 ms each where each frame is divided into four 60 sample or 7.5 ms subframes, and generates two sets of LP coefficients. The first set is used for perceptual weighting (the "unquantized LP coefficients") by, defining a perceptual weighting filter that reshapes the error signal so that more emphasis is placed on the frequencies with greater perceptual importance. The second set of LP coefficients is used for synthesis filtering (the "synthesis LP coefficients"or "quantized LP coefficients") by defining a synthesis filter.

The unquantized LP coefficients are determined by high pass filtering the speech signal 11; setting an index "i" equal to one 12; windowing the i-th subframe of the filtered speech signal 14; determining the unquantized LP coefficients through autocorrelation 18; determining if the index equals 4 20, wherein if the index does not equal four, incrementing the index by one so that i=i+1 22, reperforming steps 14, 18, and repeating steps 20, 22, 14 and 18 until the index does equal 4, when the index does equal four, the unquantized LP coefficients of the fourth subframe are used to determine the quantized or synthesis LP coefficients in steps 24, 26, 28 and 30.

High pass filtering the speech signal 11 basically includes removing the DC component of the speech signal. Windowing the i-th subframes of the filtered speech signal 14 basically includes: windowing the filtered speech signal with a 180-sample Hamming window which is centered at each 60-sample subframe. Determining the unquantized LP coefficients using autocorrelation includes performing the autocorrelation calculation; and solving the normal equation using the Levinson-Durbin algorithm, as described previously herein.

Steps 24, 26, 28, and 30 determine the synthesis LP coefficients. More specifically, these steps include: transforming the unquantized LP coefficients of the 4-th subframe into LSP coefficients 24; quantizing the LSP coefficients 26; interpolating the quantized LSP coefficients with the quantized LSP coefficients of the fourth subframe of the previous frame to create four sets of interpolated quantized LSP coefficients 28; and transforming the four sets of interpolated quantized LSP coefficients into four sets of quantized LP coefficients 30.Transforming the unquantized LP coefficients of the fourth subframe into LSP coefficients 24 can be accomplished using known techniques. Quantizing the LSP coefficients 26 includes choosing a codeword from a codebook so that the distance between the unquantized LSP coefficients and the quantized LSP coefficients is minimized. Interpolating the quantized LSP coefficients includes interpolating each quantized LSP coefficient with the quantized LSP coefficient from the previous frame to create four sets of interpolated quantized LSP coefficients, one for each subframe. Transforming the four sets of interpolated quantized LSP coefficients into four sets of synthesis LP coefficients 22 may be accomplished using known methods. Each set of synthesis LP coefficients may then be used to create a synthesis filter for each subframe.

BRIEF SUMMARY

An improved G.723.1 standard has been created primarily by replacing the window used during the LPA process of the G.723.1 standard with an optimized window. Further improvements to the LPA process can be obtained by adding a second window or by adding a second window and the determination of an additional set of unquantized LP coefficients. The improved G.723.1 standard demonstrates an improvement in subjective quality over the known G.723.1.

The standard Hamming window used by the G.723.1 standard can be optimized in two ways. The first way is through the use of a "primary optimization procedure" to produce a first optimized window. The second is through the use of an "alternate optimization procedure" to produce a second optimized window. These window optimization procedures rely on the principle of gradient-descent to find a window sequence that will either minimize the prediction error energy or maximize the segmental prediction gain. Although both optimization procedures involve determining a gradient, the primary optimization procedure uses a Levinson-Durbin based algorithm to determine the gradient while the alternate optimization procedure uses an estimate based on the basic definition of a partial derivative.

When the standard Hamming window is replaced by a single optimized window, the optimized window may be created by either the primary or alternate optimization procedure. This optimized window windows the four subframes of the speech signal to create four optimized windowed speech signals. These four windowed optimized speech signals are used to determine optimized unquantized LP coefficients, which are used to define the perceptual weighting filter and to determine the quantized or synthesis LP coefficients.

In contrast, when the standard Hamming window is replaced by two windows, the first window is used to window the subframes used to determine the optimized unquantized LP coefficients used to define the perceptual weighting filter and the second window is used to window the subframes used to determine the optimized quantized LP coefficients. The first window may be an optimized window created by either the primary or the alternate optimization procedures. However, the second window may not be an optimized window created using the alternate optimization procedure.

In some cases where the standard Hamming window is replaced by two windows, an additional set of unquantized LP coefficients is determined. In these cases, the fourth subframe is windowed twice, once with each window, to produce a windowed fourth subframe and an additional windowed fourth subframe. The windowed fourth subframe is used along with the unquantized LP coefficients for the first, second, and third subframes to define a perceptual weighting filter. The additional windowed fourth subframe is also used to determine unquantized LP coefficients, therefore requiring an additional unquantized LP coefficient determination. The unquantized LP coefficients determined using the windowed fourth subframe are then used to determine the quantized LP coefficients.

Also presented herein are windows optimized using the primary and alternate optimization procedures. The efficacy of these optimized windows for use in the G.723.1 standard is demonstrated through test data showing improvements in objective and subjective speech quality both within and outside a training data set. Improved G.723.1 standards, using a variety of window combinations, wherein each contains at least one optimized window, showed an increase in PESQ (perceptual evaluation of speech quality) score over the known G.732.1 standard. Among the improved G.723.1 standards, the one wherein the standard Hamming window was replaced by two windows and included the determination of an additional set of optimized unquantized LP coefficients demonstrated the greatest increase in subjective quality.

These optimization procedures, the optimized windows and the methods for optimizing the G.723.1 standard can be implemented as computer readable software code which may be stored on a processor, a memory device or on any other computer readable storage medium. Alternatively, the software code may be encoded in a computer readable electronic or optical signal. Additionally, the optimization procedures, the optimized windows and the methods for optimizing the G.723.1 standard may be implemented in a window optimization device which generally includes a window optimization unit and may also include an interface unit. The optimization unit includes a processor coupled to a memory device. The processor performs the optimization procedures and obtains the relevant information stored on the memory device. The interface unit generally includes an input device and an output device, which both serve to provide communication between the window optimization unit and other devices or people.

BRIEF DESCRIPTION OF SEVERAL VIEWS OF THE DRAWINGS

This disclosure may be better understood with reference to the following figures and detailed description. The components in the figures are not necessarily to scale, emphasis being placed upon illustrating the relevant principles. Moreover, like reference numerals in the figures designate corresponding parts throughout the different views.

FIG. 16 is a table summarizing the PESQ scores determined for various embodiments of speech coding systems implementing the G.723.1 standard with various embodiments of window sequences;

FIG. 17 is a table summarizing additional PESQ scores determined for various embodiments of speech coding systems implementing the G.723.1 standard with various embodiments of window sequences.

DETAILED DESCRIPTION

Figure 1:
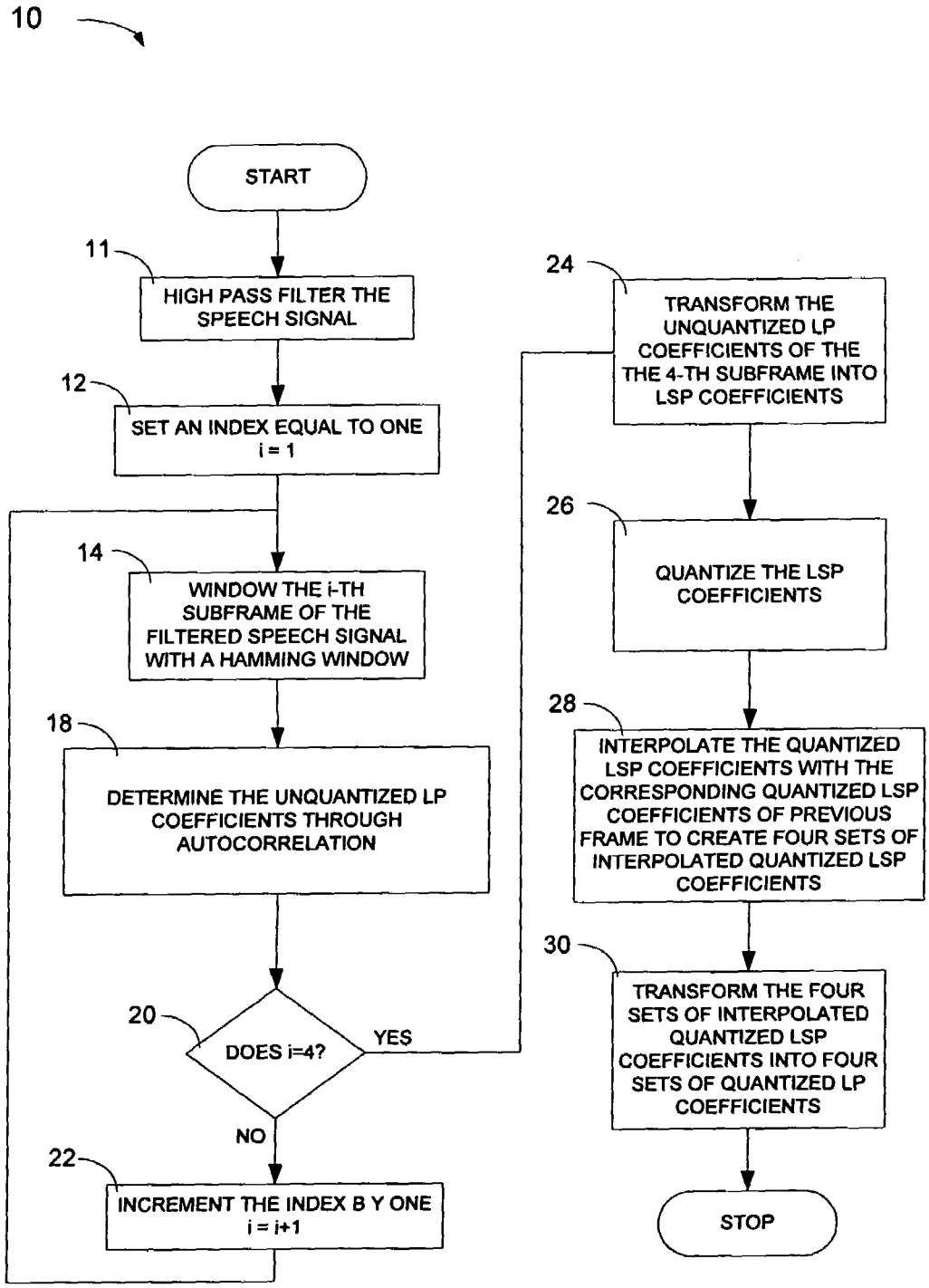
FIG. 1 (PRIOR ART)
FIG. 1 is a flow chart of the linear predictive analysis used by the G.723.1 speech coding standard according to the prior art.

The shape of the window used during LPA can be optimized through the use of window optimization procedures which rely on gradient-descent based methods ("gradient-descent based window optimization procedures" or hereinafter "optimization procedures"). Window optimization may be achieved fairly precisely through the use of a primary optimization procedure, or less precisely through the use of an alternate optimization procedure. The primary optimization and the alternate optimization procedures are both based on finding the window sequence that will either minimize the prediction error energy ("PEEN") or maximize the prediction gain ("PG"). Additionally, although both the primary optimization procedure and the alternate optimization procedure involve determining a gradient, the primary optimization procedure uses a Levinson-Durbin based algorithm to determine the gradient while the alternate optimization procedure uses the basic definition of a partial derivative to estimate the gradient. Improvements in the LPA procedure obtained by using the window optimization procedures are demonstrated by experimental data that compares the time-averaged PEEN (the "prediction-error power" or "PEP") and the time-averaged PG (the "segmental prediction gain" or "SPG") obtained using window segments that were not optimized at all to the PEP and SPG obtained using window segments that were optimized using the optimization procedures.

The optimization procedures optimize the shape of the window sequence used during LPA by minimizing the PEEN or maximizing PG. The PG at the synthesis interval $n \in [n_1, n_2]$ is defined by the following equation:

$$PG = 10\log_{10}\left(\sum_{n=n_1}^{n_2}(s[n])^2 \Big/ \sum_{n=n_1}^{n_2}(e[n])^2\right), \tag{10}$$

wherein PG is the ratio in decibels ("dB") between the speech signal energy and prediction error energy. For the same synthesis interval $n \in [n_1, n_2]$, the PEEN is defined by the following equation:

$$J = \sum_{n=n_1}^{n_2}(e[n])^2 = \sum_{n=n_1}^{n_2}(s[n] - \hat{s}[n])^2 = \sum_{n=n_1}^{n_2}\left(s[n] + \sum_{i=1}^{M} a_i s[n-i]\right)^2 \tag{11}$$

wherein e[n] denotes the prediction error; s[n] and $\hat{s}[n]$ denote the speech signal and the predicted speech signal, respectively; the coefficients $a_i$, for i=1 to M are the LP coefficients, with M being the prediction order. The minimum value of the PEEN, denoted by J, occurs when the derivatives of J with respect to the LP coefficients equal zero.

Because the PEEN can be considered a function of the N samples of the window, the gradient of J with respect to the window sequence can be determined from the partial derivatives of J with respect to each window sample:

$$\nabla J = \left[\frac{\partial J}{\partial w[0]}\ \frac{\partial J}{\partial w[1]} \cdots \frac{\partial J}{\partial w[N-1]}\right]^T, \tag{12}$$

where T is the transpose operator. By finding the gradient of J, it is possible to adjust the window sequence in the direction negative to the gradient so as to reduce the PEEN. This is the principle of gradient-descent. The window sequence can then be adjusted and the PEEN recalculated until a minimum or otherwise acceptable value of the PEEN is obtained.

Both the primary and alternate optimization procedures obtain the optimum window sequence by using LPA to analyze a set of speech signals and using the principle of gradient-descent. The set of speech signals $\{s_k[n], k=0, 1, \ldots, N_t-1\}$ used is known as the training data set which has size $N_t$, and where each $s_k[n]$ is a speech signal which is represented as an array containing speech samples. Generally, the primary and alternate optimization procedures include an initialization procedure, a gradient-descent procedure and a stop procedure. During the initialization procedure, an initial window sequence $w_m$ is chosen and the PEP of the whole training set is computed, the results of which are denoted as $PEP_0$. $PEP_0$ is computed using the initialization routine of a Levinson-Durbin algorithm. The initial window sequence includes a number of window samples, each denoted by w[n] and can be chosen arbitrarily.

During the gradient-descent procedure, the gradient of the PEEN is determined and the window sequence is updated. The gradient of the PEEN is determined with respect to the window sequence $w_m$, using the recursion routine of the Levinson-Durbin algorithm, and the speech signal $s_k$ for all speech signals ($k \leftarrow 0$ to $N_t-1$). The window sequence is updated as a function of the window sequence and a window update increment. The window update increment is generally defined prior to executing the optimization procedure.

The stop procedure includes determining if the threshold has been met. The threshold is also generally defined prior to using the optimization procedure and represents an amount of acceptable error. The value chosen to define the threshold is based on the desired accuracy. The threshold is met when the PEP for the whole training set $PEP_m$, determined using window sequence $w_m$ for the whole training set, has not decreased substantially with respect to the prior PEP, denoted as $PEP_{m-1}$ (if M=0 the $PEP_{m-1}=0$). Whether $PEP_m$ has decreased substantially with respect to $PEP_{m-1}$ is determined by subtracting $PEP_m$ from $PEP_{m-1}$ and comparing the resulting difference to the threshold. If the resulting difference is greater than the threshold, the gradient-descent procedure (including updating the window sequence so that $m \leftarrow m+1$) and the stop procedure are repeated until the difference is equal to or less than the threshold. The performance of the optimization procedure for each window sequence, up to and including reaching the threshold, is know as one epoch. In the following description, the subscript m denoting the window sequence to which each equation relates is omitted in places where the omission improves clarity.

Figure 2:
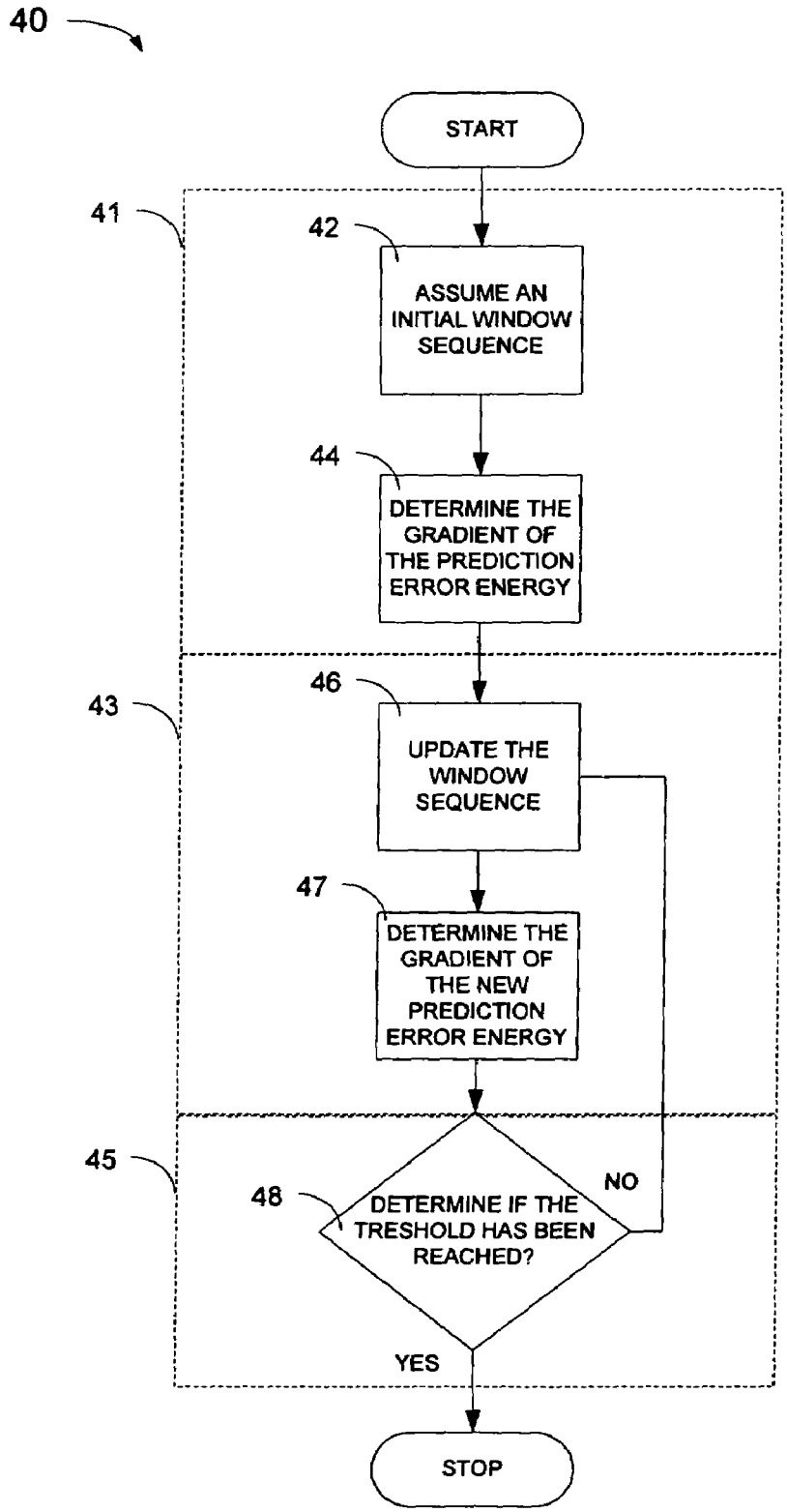
FIG. 2 is a flow chart of one embodiment of a primary optimization procedure.

The primary window optimization procedure is shown in FIG. 2 and indicated by reference number 40. This primary window optimization procedure 40 generally includes, applying an initialization procedure 41, a gradient-descent procedure 43, and a stop procedure 45. The initialization procedure includes, assuming an initial window sequence 42, and determining the gradient of the PEEN 44. The gradient-descent procedure 43 includes, updating the window sequence 46, and determining the gradient of the new PEEN 47. The stop procedure 45 includes determining if a threshold has been met 48, and if the threshold has not been met repeating the gradient-descent 43 and stop 45 procedures until the threshold is met.

Figure 3:
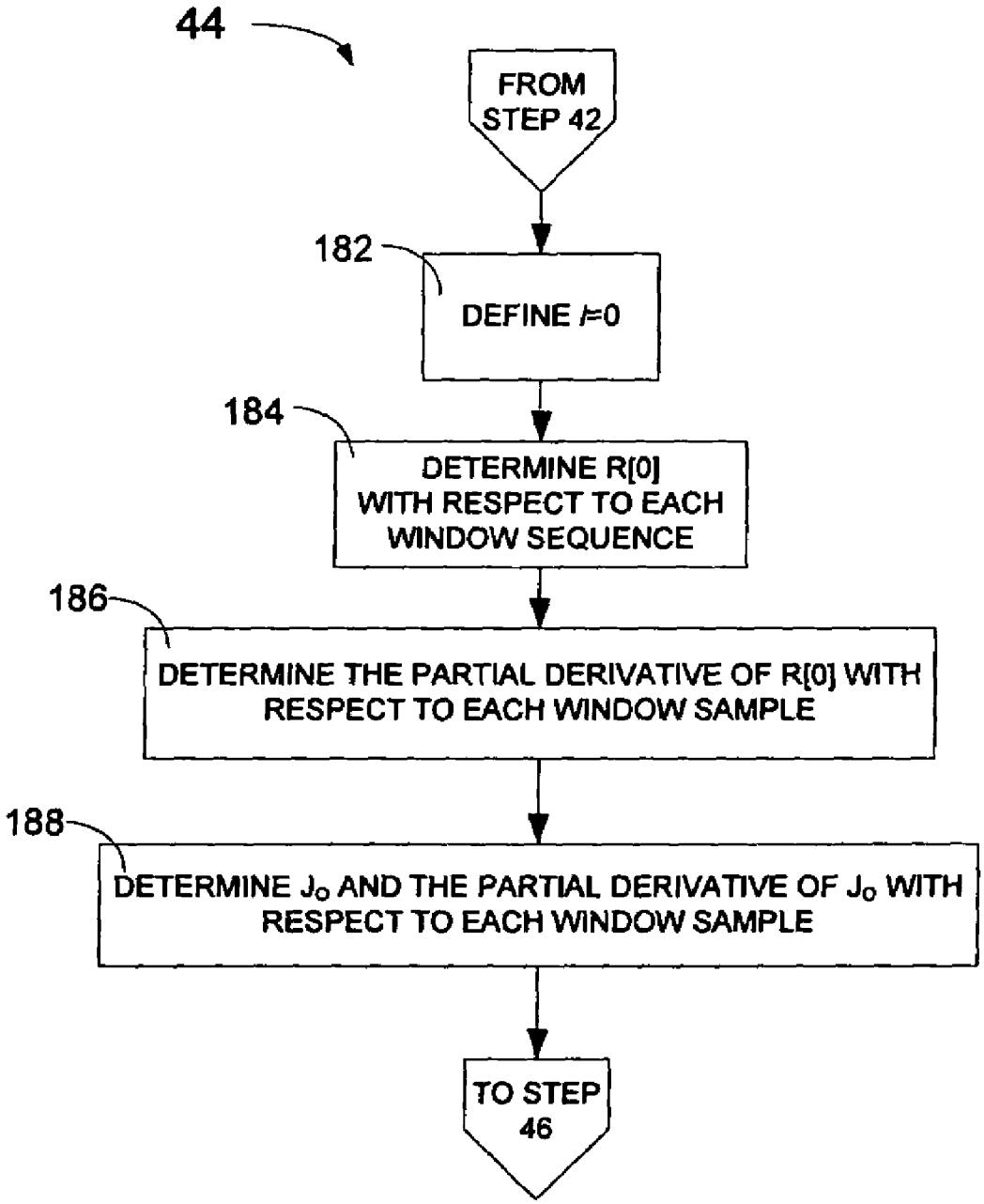
FIG. 3 is a flow chart of one embodiment of a procedure for determining a zero-order gradient.

During the initialization procedure 41, an initial window sequence is assumed 42 and the gradient of the PEEN is determined with respect to the initial window (the "initial PEEN"). Generally, the initial window sequence $w_o$ is defined as a rectangular window sequence but may be defined as any window sequence, such as a sequence with tapered ends. The step of determining the gradient of the initial PEEN 44 is shown in more detail in FIG. 3. Generally, the gradient of the initial PEEN is determined by the initialization procedure of the Levinson-Durbin algorithm and includes defining a time-lag l as zero 182, determining the autocorrelation value for l=0 with respect to each window sample (the "initial autocorrelation values" or "R[0]") 184, determining the partial derivative of the initial autocorrelation values, and determining the PEEN and the partial derivative of PEEN for l=0 with respect to each window sample ("$J_o$") 188.

Determining the initial autocorrelation values R[0] with respect to each window sample 184 includes determining the initial autocorrelation values as a function of the window sequence and the speech signal as defined by equation (9) for l=0. Once R[0] is determined, $J_o$ is determined as a function of R[0], wherein $J_o$=R[0]. The partial derivative of R[0] is then determined in step 186 from known values of the partial derivatives of R[l] which are defined by the following equation:

$$\frac{\partial R[l]}{\partial w[n]} = \begin{cases} w[n+l]s[n+l]s[n]; & 0 \le n < l \\ w[n-1]s[n-1]s[n]; & N-l \le n < N \\ s[n](w[n-l]s[n-l] + w[n+l]s[n+l]); & \text{otherwise} \end{cases} \tag{13}$$

In step 188 the PEEN and the partial derivative of PEEN $J_o$ with respect to each window sample can be determined from the relationships between $J_o$ and R[0] and between the partial derivative of $J_o$ and the partial derivative of R[0], respectively, as defined in the Levinson-Durbin algorithm (the "zero-order predictor"):

$$J_o = R[0] \tag{14a}$$

$$\frac{\partial J_0}{\partial w[n]} = \frac{\partial R[0]}{\partial w[n]}; n = 0, \ldots, N-1. \tag{14b}$$

Referring now to FIG. 2, during the gradient-descent procedure 43, the window sequence is updated in step 46 and the gradient of the PEEN determined with respect to the window sequence (the "new PEEN") 47. The window sequence is updated as a function of a window update increment, which is referred to as a step size parameter μ:

$$w_m[n] \leftarrow w_m[n] - \mu \cdot \frac{\partial J}{\partial w_m[n]}; n = 0, \ldots, N-1 \tag{15}$$

Figure 4:
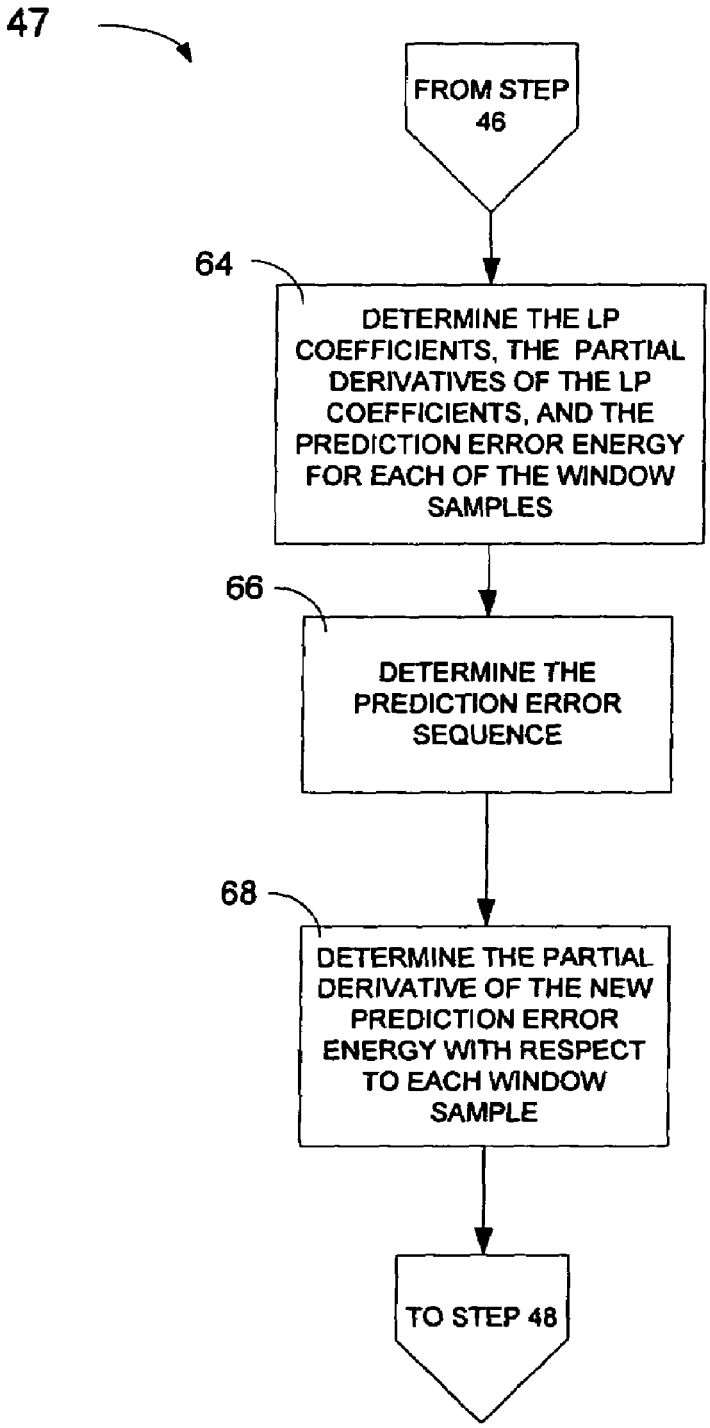
FIG. 4 is a flow chart of one embodiment of a procedure for determining an l-order gradient.

The step of determining the gradient of the new PEEN 47 is shown in more detail in FIG. 4. Determining the gradient of new PEEN 47 includes determining the LP coefficients and the partial derivatives of the LP coefficients for each window sample 64, determining the prediction error sequence e[n] 66, and determining PEEN and the partial derivatives of PEEN with respect to each window sample 68.

Figure 5:
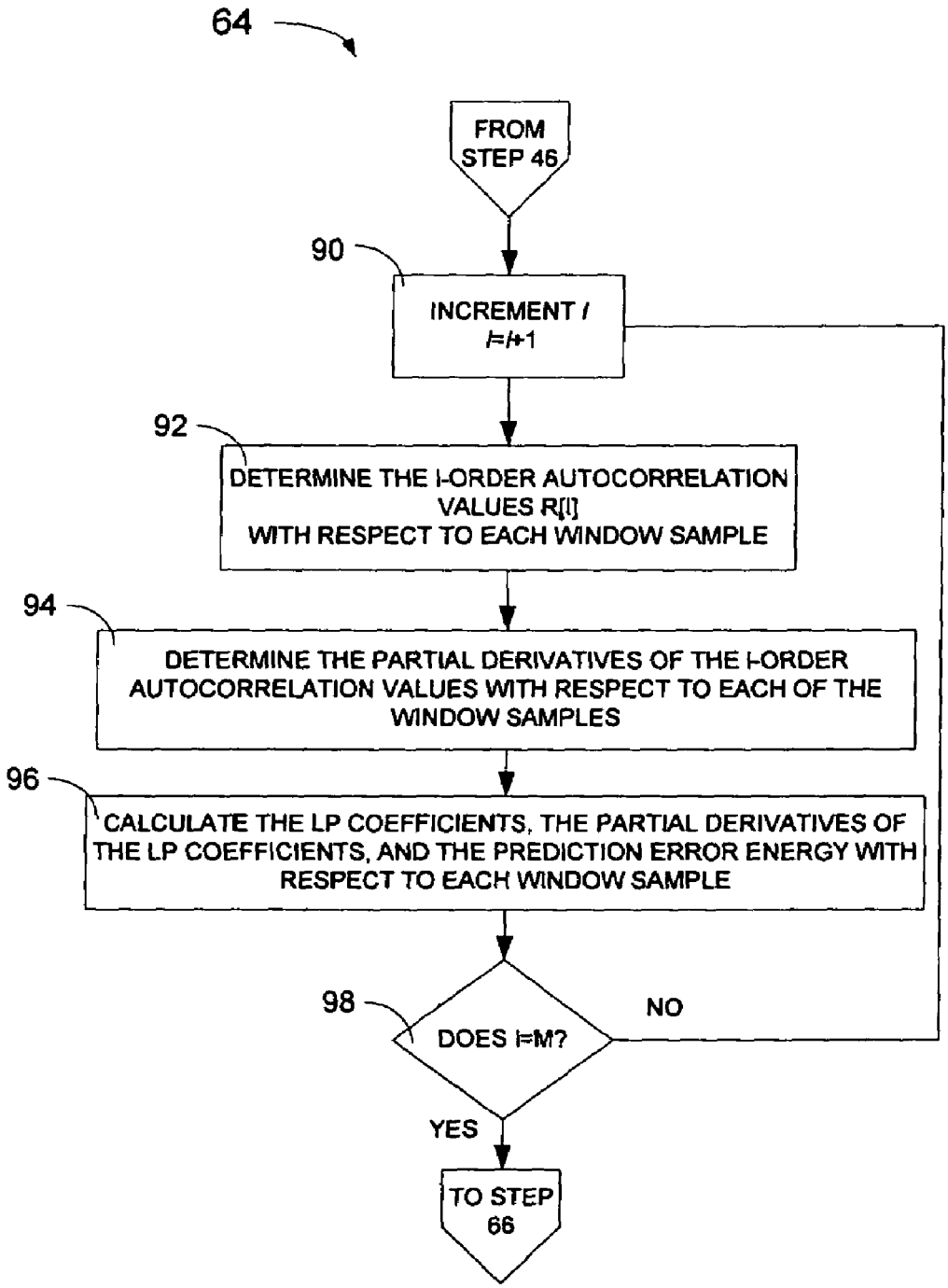
FIG. 5 is a flow chart of one embodiment of a procedure for determining the LP coefficients and the partial derivative of the LP coefficients.

The step of determining the LP coefficients and the partial derivatives of the LP coefficients 64 is shown in more detail in FIG. 5. The LP coefficients and the partial derivatives of the LP coefficients are determined using a method based on the recursion routine of the Levinson-Durbin algorithm which includes incrementing l so that l=l+1 90, determining the l-order autocorrelation values R[l] with respect to each window sample 92, determining the partial derivatives of the l-order autocorrelation values with respect to each the window sample 94, determining the LP coefficients and the partial derivatives of the LP coefficients with respect to each window sample 96, determining whether l equals the prediction order M 98 and repeating steps 90 through 98 until l does equal M.

After l is incremented in step 90, the l-order autocorrelation values are determined using equation (9) for each window sample (denoted in equation (9) by the index variable k). Then in step 92, the partial derivatives of the l-order autocorrelation values are determined from the known values defined in equation (13).

Figure 6:
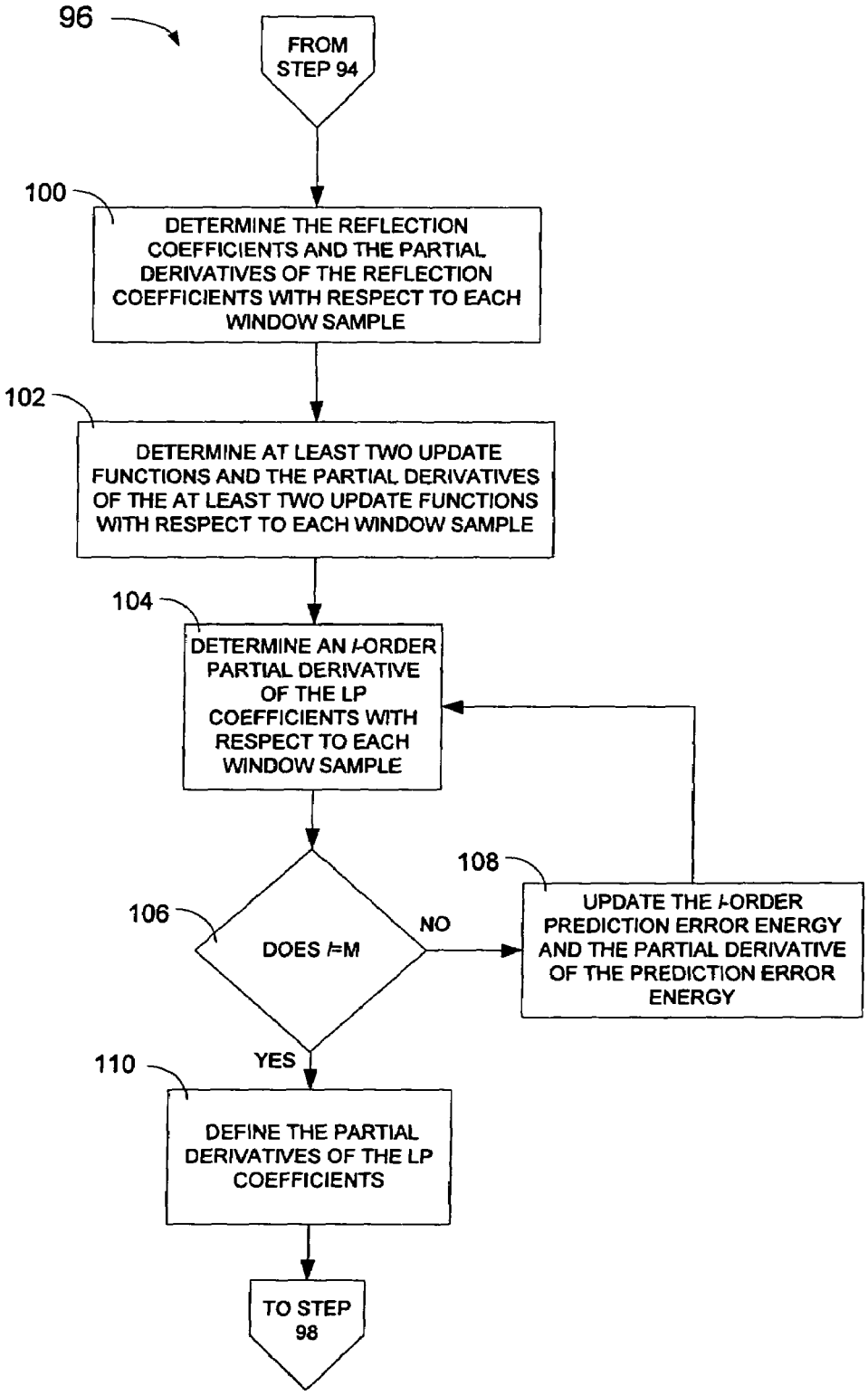
FIG. 6 is a flow chart of another embodiment of a procedure for calculating LP coefficients and the partial derivative of LP coefficients.

The step of determining the LP coefficients $a_i$ and the partial derivatives of the LP coefficients with respect to each window sample $$\frac{\partial a_i}{\partial w[n]}96,$$

includes calculating the LP coefficients and the partial derivatives of the LP coefficients with respect to each window sample as a function of the zero-order predictors determined in equations (14a) and (14b), respectively, and the reflection coefficients and the partial derivatives of reflection coefficients, respectively, and is shown in more detail in FIG. 6. The step of calculating the LP coefficients and the partial derivatives of the LP coefficients 96 includes, determining the reflection coefficients and the partial derivatives of reflection coefficients with respect to each window sample 100, determining an update function and a partial derivative of an update function with respect to each window sample 102, determining an l-order LP coefficient and the partial derivatives of the LP coefficients 104, determining if l=M 106, wherein if l does not equal M updating the l-order partial derivatives of the PEEN 108 and repeating steps 104 and 106 until l does equal M in step 106.

The reflection coefficients and the partial derivatives of reflection coefficients with respect to each window sample are determined in step 100 from equations:

$$k_l - \frac{1}{J_{l-1}}\left(R[l] + \sum_{i=1}^{l-1} a_i^{l-1} R[l-1]\right) \tag{16a}$$

$$\frac{\partial k_l}{\partial w[n]} = \frac{1}{J_{l-1}}\left(\frac{\partial R[l]}{\partial w[n]} - \frac{R[l]}{J_{l-1}}\frac{\partial J_{l-1}}{\partial w[n]} + \sum_{i=1}^{l-1} a_i^{(l-1)}\frac{\partial R[l-i]}{\partial w[n]} + R[l-i]\frac{\partial a_i^{(l-1)}}{\partial w[n]} - \frac{a_i^{(l-1)} R[l-i]}{J_{l-1}}\frac{\partial J_{l-1}}{\partial w[n]}\right), \tag{16b}$$

The update function and the partial derivative of the update function are then determined with respect to each window sample in step 102 by equations:

$$a_l^{(l)} = -k_l \tag{17a}$$

-continued $$\frac{\partial a_l^{(l)}}{\partial w[n]} = -\frac{\partial k_l}{\partial w[n]}, \tag{17b}$$

The l-order LP coefficients and the partial derivatives of the l-order LP coefficients with respect to each window sample for i=1, 2, . . . , l−1 are determined in step 104. The l-order LP coefficients are determined by equations:

$$a_i^{(l)} = -k_l \tag{18a}$$

$$a_i^{(l)} = a_i^{(l-1)} - k_l a_{l-i}^{(l-1)} \tag{18a}$$

and the partial derivatives of the l-order LP coefficients are determined by equations:

$$\frac{\partial a_l^{(l)}}{\partial w[n]} = -\frac{\partial k_l}{\partial w[n]} \tag{18c}$$

$$\frac{\partial a_i^{(l)}}{\partial w[n]} = \frac{\partial a_i^{(l-1)}}{\partial w[n]} - a_{l-i}^{(l-1)} - k_l \frac{\partial a_{l-i}^{(l-1)}}{\partial w[n]} \tag{18d}$$

So long as l does not equal M, the l-order PEEN and the l-order partial derivative of the PEEN are updated in step 108 by equations:

$$J_l = J_l - 1(1 - k_l^2) \tag{19a}$$

$$\frac{\partial J_l}{\partial w[n]} = (1 - k_l^2)\frac{\partial J_{l-1}}{\partial w[n]} - 2k_l J_{l-1}\frac{\partial k_l}{\partial w[n]}. \tag{19b}$$

Once l does equal M, the LP coefficients and the partial derivatives of the LP coefficients are defined by $$a_i = a_i^{(M)} \text{ and } \frac{\partial a_i}{\partial w[n]} = \frac{\partial a_i^{(M)}}{\partial w[n]},$$

respectively, in step 110.

Referring now to FIG. 4, the prediction error sequence is determined in step 66 from the relationship among the prediction error sequence, the speech signal and the LP coefficients as defined in equation (11):

$$\sum_{n=n_1}^{n_2} (e[n]) = \sum_{n=n_1}^{n_2}\left(s[n] + \sum_{i=1}^{M} a_i s[n-i]\right) \tag{20}$$

Then, in step 68, the partial derivative of PEEN with respect to each window sample is determined by deriving the derivative of PEEN from the definition of PEEN given in equation (11) and solving for $$\frac{\partial J}{\partial w[n]}:$$

$$\frac{\partial J}{\partial w[n]} = \sum_{k=n_1}^{n_2} 2e[k]\frac{\partial e[k]}{\partial w[n]} = \sum_{k=n_1}^{n_2} 2e[k]\left(\sum_{i=1}^{M} s[k-i]\frac{\partial a_i}{\partial w[n]}\right) \tag{21}$$

Referring now to FIG. 2, a determination is made as to whether a threshold has been met in step 48. This includes comparing the derivative of the PEEN obtained for the current window sequence $w_m[n]$ with that of the previous window sequence $W_{m-l}[n]$ (if m=0, $w_{m-l}[n]=0$). If the difference between $w_m[n]$ and $w_{m-l}[n]$ is greater than a previously-defined threshold, the threshold has not been met the window sequence is updated in step 50 according to equation (15), and steps 46, 47 and 48 are repeated until the difference between $w_m[n]$ and $w_{m-l}[n]$ is less than or equal to the threshold. If the difference between $w_m[n]$ and $w_{m-l}[n]$ is less than or equal to the threshold, the entire process, including steps 42 through 48, are repeated.

As applied to speech coding, linear prediction has evolved into a rather complex scheme where multiple transformation steps among the LP coefficients are common; some of these steps include bandwidth expansion, white noise correction, spectral smoothing, conversion to line spectral frequency, and interpolation. Under these and other circumstances, it is not feasible to find the gradient using the primary optimization procedure. Therefore, numerical method such as the alternate optimization procedure can be used.

Figure 7:
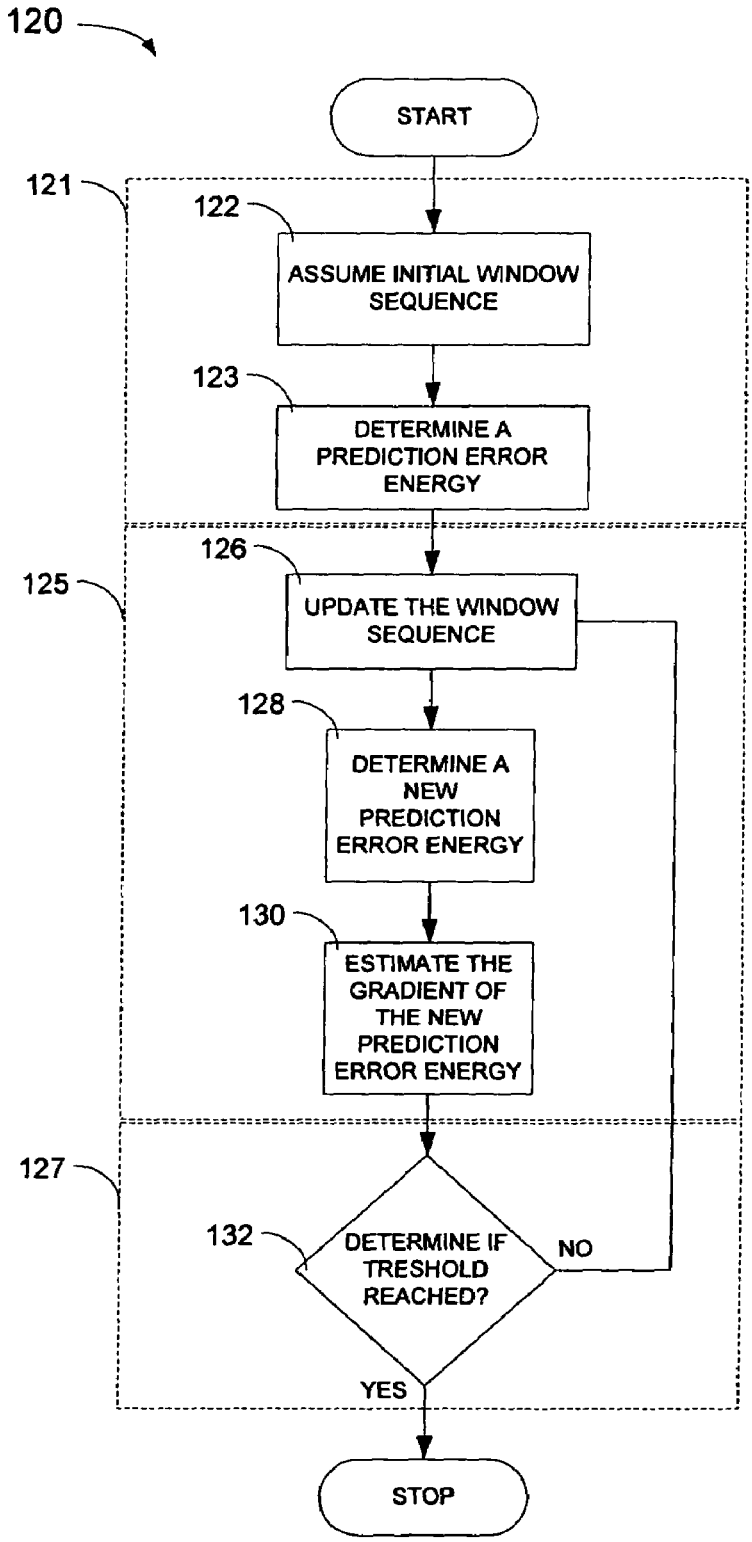
FIG. 7 is a flow chart of one embodiment of an alternate optimization procedure.

The alternate optimization procedure is shown in FIG. 7 and indicated by reference number 120. The alternate optimization procedure 120 includes an initialization procedure 121, a gradient-descent procedure 125 and a stop procedure 127. The initialization procedure 121 includes assuming an initial window sequence 122, and determining a prediction error energy 123. Assuming an initial window sequence in step 122 generally includes assuming a rectangular window sequence. Determining the prediction error energy in step 123 includes determining the prediction error energy as a function of the speech signal and the initial window sequence using know autocorrelation-based LPA methods.

The gradient-descent procedure 125 includes updating the window sequence 126, determining a new prediction error energy 128, and estimating the gradient of the new prediction error energy 130. The window sequence is updated as a function of the perturbation Δw to create a perturbed window sequence w'[n] defined by the equation:

$$w'[n]=w[n],\ n\neq n_o;\ w'[n_o]=w[n_o]+\Delta w,\ n=n_o \tag{22}$$

wherein Δw is known as the window perturbation constant; for which a value is generally assigned prior to implementing the alternate optimization procedure. The concept of the window perturbation constant comes from the basic definition of a partial derivative, given in the following equation:

$$\frac{\partial f(x)}{\partial x} = \lim_{\Delta x\to 0}\frac{f(\Delta x + x) - f(x)}{\Delta x}, \tag{23}$$

According to this definition of a partial derivative, the value of Δw should approach zero, that is, be as low as possible. In practice the value for Δw is selected in such a way that reasonable results can be obtained. For example, the value selected for the window perturbation constant Δw depends, in part, on the degree of numerical accuracy that the underlying system, such as a window optimization device, can handle. In general, a value of $\Delta w=10^{-7}$ to $10^{-4}$ yields satisfactory results, however, the exact value of Δw will depend on the intended application.

The prediction error energy is then determined for the perturbed window sequence (the "new prediction error energy") in step 128. The new prediction error energy is determined as a function of the speech signal and the perturbed window sequence using an autocorrelation method. The autocorrelation method includes relating the new prediction error energy to the autocorrelation values of the speech signal which has been windowed by the perturbed window sequence to obtain a "perturbed autocorrelation values." The perturbed autocorrelation values are defined by the equation:

$$R'[l, n_o] = \sum_{k=l}^{N-1} w'[k, n_o]w'[k-l, n_o]s[k]s[k-l] \tag{24}$$

wherein it is necessary to calculate all N×(M+1) perturbed autocorrelation values. However, it can easily be shown that, for l=0 to M and $n_o$=0 to N−1:

$$R'[0,n_o]=R[0]+\Delta w(2w[n_o]+\Delta w)s^2[n_o]; \tag{25}$$

and, for l=1 to M:

$$R'[l,n_o]=R[l]+\Delta w(w[n_o-l]s[n_o-l]+w[n_o+l]s[n_o+l])s[n_o]. \tag{26}$$

By using equations (24) and (25) to determine the perturbed autocorrelation values, calculation efficiency is greatly improved because the perturbed autocorrelation values are built upon the results from equation (9) which correspond to the original window sequence.

Estimating the gradient of the new PEEN in step 130 includes determining the partial derivatives of the PEEN with respect to each window sample $\partial J/\partial w[n_o]$. These partial derivatives are estimated using an estimation based on the basic definition of a partial derivative. Assuming that a function $f(x)$ is differentiable:

$$\frac{\partial f(x)}{\partial x} = \lim_{\Delta x\to 0}\frac{f(\Delta x + x) - f(x)}{\Delta x}, \tag{27}$$

using this definition, the partial derivate of $\partial J/\partial w[n_o]$ can be estimated by the following equation:

$$(J'[n_o]-J)/\Delta w. \tag{28}$$

According to equation (26), if the value of Δw is low enough, it is expected that the estimate given in equation (27) is close to the true derivative.

The stop procedure includes determining whether a threshold is met 132, and if the threshold is not met, repeating steps 126 through 132 until the threshold is met. Once the partial derivatives of $\partial J/\partial w[n_o]$ are determined, it is determined whether a threshold has been met. This includes comparing the derivatives of the PEEN obtained for the current window sequence $w_m[n_o]$ with those of the previous window sequence $w_{m-l}[n_o]$. If the difference between $W_m[n_o]$ and $w_{m-l}[n_o]$ is greater than a previously-defined threshold, the threshold has not been met and the gradient-descent procedure 125 and the stop procedure 27 are repeated until the difference between $w_m[n_o]$ and $w_{m-l}[n_o]$ is less than or equal to the threshold.

Implementations and embodiments of the primary and secondary alternate gradient-descent based window optimization algorithms include computer readable software code. These algorithms may be implemented together or independently. Such code may be stored on a processor, a memory device or on any other computer readable storage medium. Alternatively, the software code may be encoded in a computer readable electronic or optical signal. The code may be object code or any other code describing or controlling the functionality described herein. The computer readable storage medium may be a magnetic storage disk such as a floppy disk, an optical disk such as a CD-ROM, semiconductor memory or any other physical object storing program code or associated data.

Several experiments were performed to observe the effectiveness of the primary optimization procedure. All experiments share the same training data set which was created using 54 files from the TIMIT database (see J. Garofolo et al, *DARPA TIMIT, Acoustic-Phonetic Continuous Speech Corpus CD-ROM*, National Institute of Standards and Technology, 1993.) (downsampled to 8 kHz), and with a total duration of approximately three minutes. To evaluate the capability of the optimized window to work for signals outside the training data set, a testing data set was formed using 6 files not included in the training data set with a total duration of roughly 8.4 second. The prediction order M was always set equal to ten.

In the first experiment, the primary optimization procedure was applied to initial window sequences having window lengths N of 120, 140, 160, 200, 240, and 300 samples. The total number of training epochs m was defined as 100, and the step size parameter was defined as $\mu=10^{-9}$. The initial window was rectangular for all cases. In addition, the analysis interval was made equal to the synthesis interval and equal to the window length of the window sequence.

Figure 8:
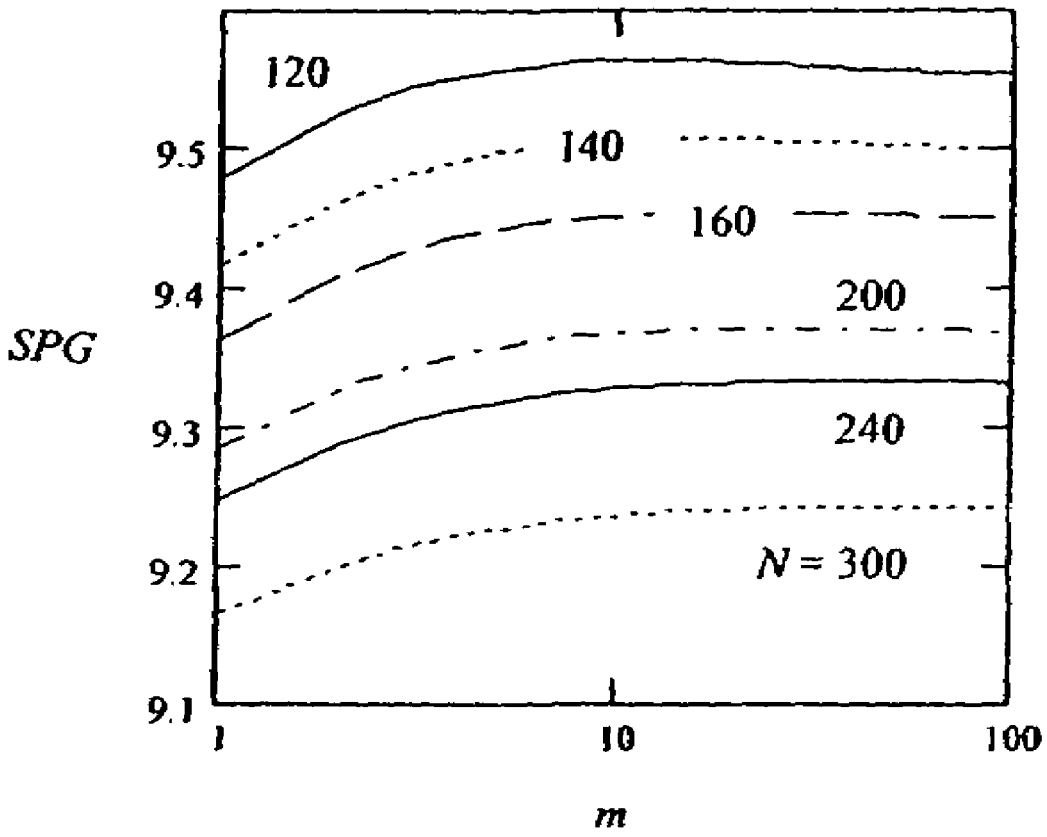
FIG. 8 is a graph of the segmental prediction gain associated with various embodiments of optimized windows as a function of training epoch for various window sequence lengths, obtained through experimentation.
Figure 9A:
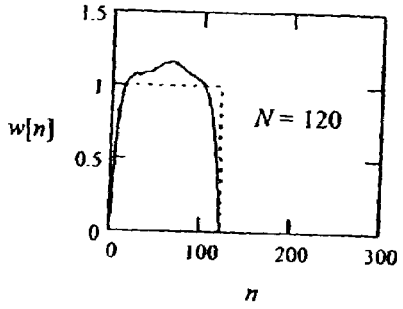
FIG. 9*a* is a graph of the initial window sequence and one embodiment of a final window sequence for a window length of 120, obtained through experimentation.
Figure 9B:
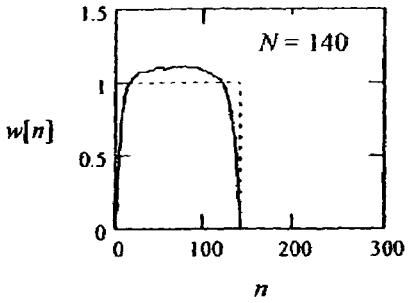
FIG. 9*b* is a graph of the initial window sequence and one embodiment of a final window sequence for a window length of 140, obtained through experimentation.
Figure 9C:
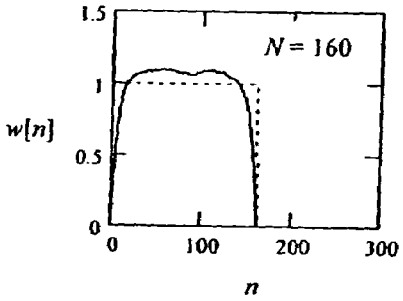
FIG. 9*c* is a graph of the initial window sequence and one embodiment of a final window sequence for a window length of 160, obtained through experimentation.
Figure 9D:
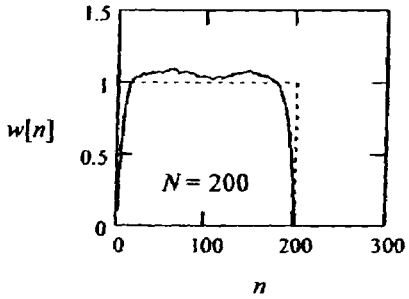
FIG. 9*d* is a graph of the initial window sequence and one embodiment of a final window sequence for a window length of 200, obtained through experimentation.
Figure 9E:
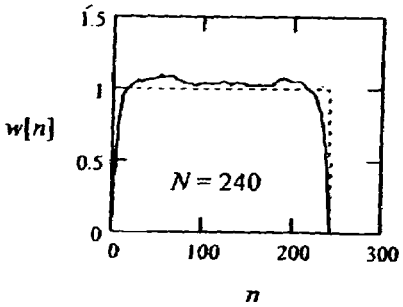
FIG. 9*e* is a graph of the initial window sequence and one embodiment of a final window sequence for a window length of 240, obtained through experimentation.
Figure 9F:
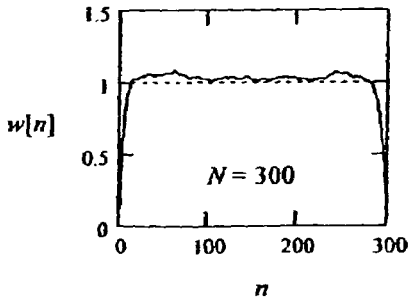
FIG. 9*f* is a graph of the initial window sequence and one embodiment of a final window sequence for a window length of 300, obtained through experimentation.

FIG. 8 shows the SPG results for the first experiment. The SPG was obtained for windows of various window lengths that were optimized using the primary optimization procedure. The SPG grows as training progresses and tends to saturate after roughly 20 epochs. Performance gain in terms of SPG is usually high at the beginning of the training cycles with gradual lowering and eventual arrival at a local optimum. Moreover, longer windows tend to have lower SPG, which is expected since the same prediction order is applied for all cases, and a lower number of samples are better modeled by the same number of LP coefficients.

Figures 12, 13:
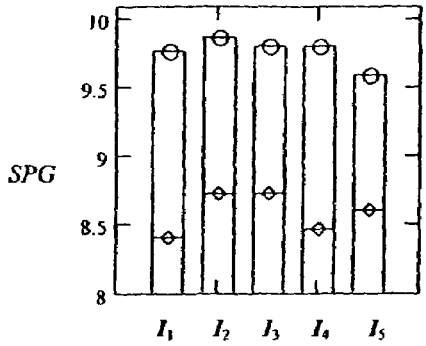
FIG. 12 is a bar graph of the segmental prediction gain before and after the application of one embodiment of an optimization procedure, obtained through experimentation.
FIG. 13 is table summarizing the segmental prediction gain and the prediction error power determined for various embodiments of window sequences of various window length before and after the application of one embodiment of an optimization procedure, obtained through experimentation.

FIGS. 9A through 9F show the initial (dashed lines) and optimized (solid lines) windows for the windows of various lengths. Note how all the optimized windows develop a tapered-end appearance, with the middle samples slightly elevated. The table in FIG. 13 summarizes the performance measures before and after optimization, which show substantial improvements in both SPG and PEP. Moreover, these improvements are consistent for both training and testing data set, implying that optimization gain can be generalized for data outside the training set.

A second experiment was performed to determine the effects of the position of the synthesis interval. In this experiment a 240-sample analysis interval with reference coordinate $n\in[0, 239]$ was used. Five different synthesis intervals were considered, including, $I_1=[0, 59]$, $I_2=[60, 119]$, $I_3=[120, 179]$, $I_4=[180, 239]$, and $I_5=[240, 259]$. The first four synthesis intervals are located inside the analysis interval, while the last synthesis interval is located outside the analysis interval. The initial window sequence was a 240-sample rectangular window, and the optimization was performed for 1000 epochs with a step size of $\mu=10^{-9}$.

Figure 10:
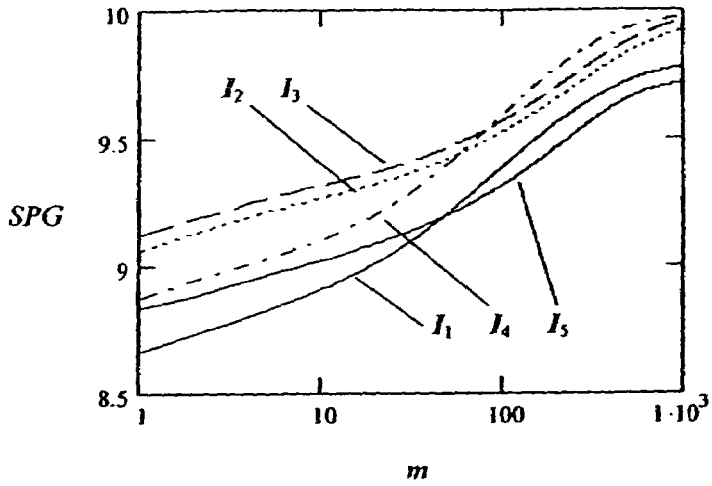
FIG. 10 is a graph of the segmental prediction gain associated with various embodiments of optimized windows as a function of the training epoch, obtained through experimentation.
Figure 11:
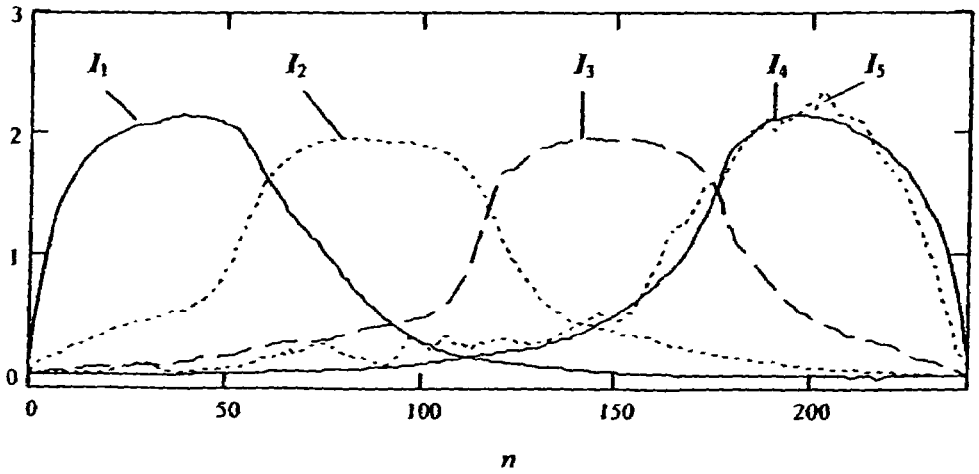
FIG. 11 is a graph of various embodiments of optimized windows, obtained experimentation.

FIG. 10 shows the results for the second experiment which include SPG as a function of the training epoch. A substantial increase in performance in terms of the SPG is observed for all cases. The performance increase for $I_1$ to $I_4$ achieved by the optimized window is due to suppression of signals outside the region of interest; while for $I_5$, putting most of the weights near the end of the analysis interval plays an important role. FIG. 11 shows the optimized windows which, as expected, take on a shape that reflects the underlying position of the synthesis interval. The SPG results for the training and testing data sets are shown in FIG. 12, where a significant improvement in SPG over that of the original rectangular window is obtained. $I_5$ has the lowest SPG after optimization because its synthesis interval was outside the analysis interval.

The primary and alternate optimization procedures can be used to optimize the window used in LPA process of the G.723.1 standard to create an improved G.723.1 standard. As previously discussed and illustrated in FIG. 1, the G.723.1 standard uses a Hamming window (the "standard Hamming window") in step 14 to window the four subframes of each frame of the original speech signal. All four resulting windowed subframes are used to determine unquantized LP coefficients for each subframe. These unquantized LP coefficients are used to form a perceptual weighting filter. In addition, the fourth windowed subframe is used to determine four sets of quantized LP coefficients (also referred to as "synthesis coefficients") used to form a synthesis filter.

To improve the G.723.1 standard, its LPA procedure is improved by replacing the single standard Hamming window with one or two windows. When the standard Hamming window is replaced by a single optimized window, the single optimized window windows all the subframes of the speech signal, producing first, second, third and fourth windowed subframes. All these windowed subframes are used to determine optimized unquantized LP coefficients which are used to define an optimized perceptual weighting filter. However, only the optimized unquantized LP coefficients of the fourth subframe are used to determine optimized quantized LP coefficients (also referred to as "optimized synthesis coefficients") which define an optimized synthesis filter.

When the standard Hamming window is replaced by two windows, one or both of the windows may be optimized. Generally, the first window will be used to determine the optimized unquantized LP coefficients used to define the perceptual weighting filter and the second window will be used to determine the optimized unquantized LP coefficients used to determine the quantized LP coefficients. In some embodiments, the first window, which may or may not be optimized, windows the first, second and third subframes, while the second window, which may or may not be optimized, windows the third subframe. All four windowed subframes are used to determine the unquantized LP coefficients used to define the perceptual weighting filter. However, only the fourth windowed subframe is used for determining the quantized LP coefficients. In other embodiments, the first window windows all four subframes producing first, second, third and fourth windowed subframes. The second windows the fourth subframe a second time producing an additional fourth windowed subframe. In these embodiments, the first, second, third and fourth subframes are used to determine the unquantized LP coefficients used to define the perceptual weighting filter. The additional fourth windowed subframe, created by the second window, is used in an additional autocorrelation calculation, to determine the unquantized LP coefficients used to determine the quantized LP coefficients.

Figure 14A:
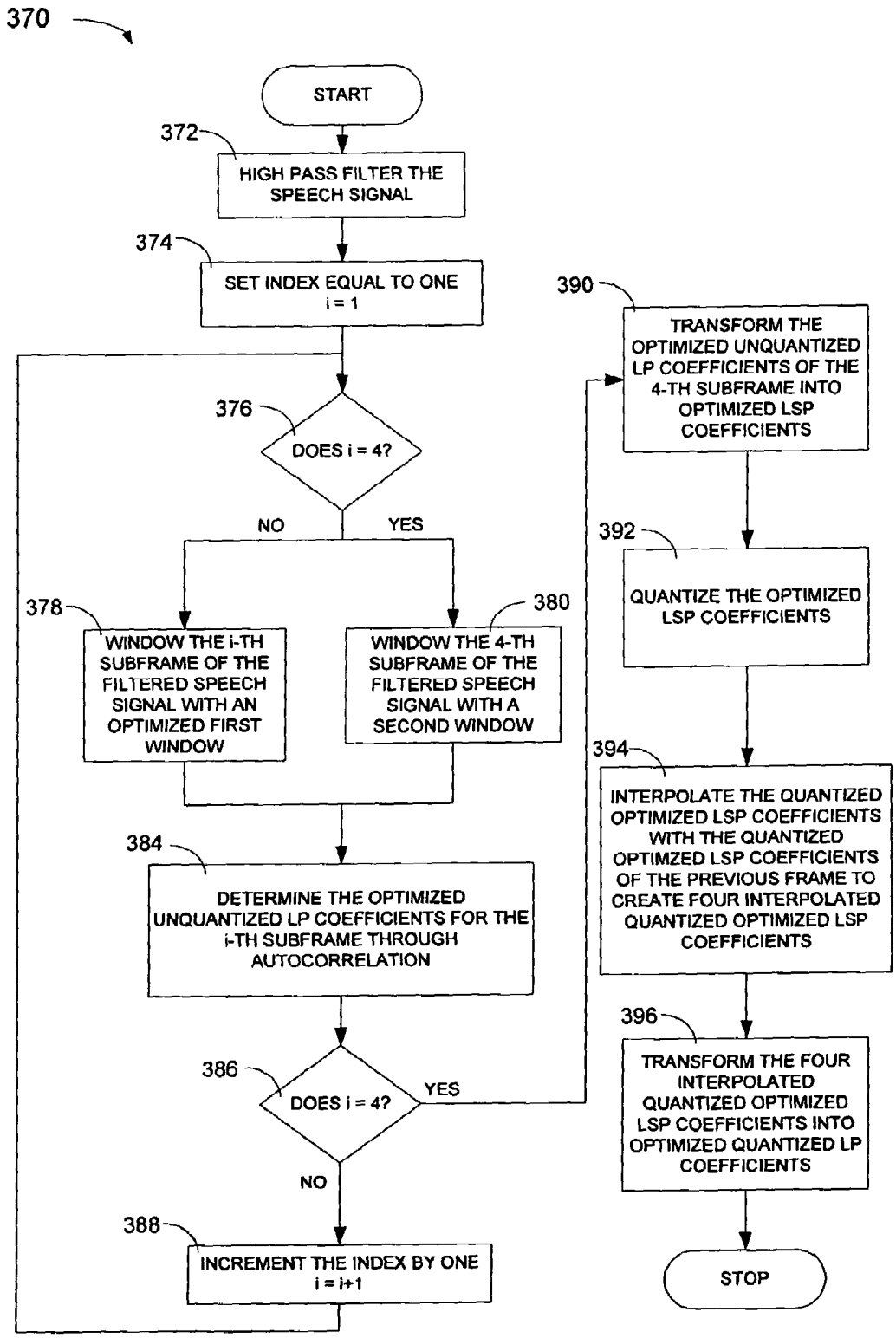
FIG. 14*a* is a flow chart of one embodiment of an improved linear predictive for use in the G.723.1 speech coding standard.
Figure 14B:
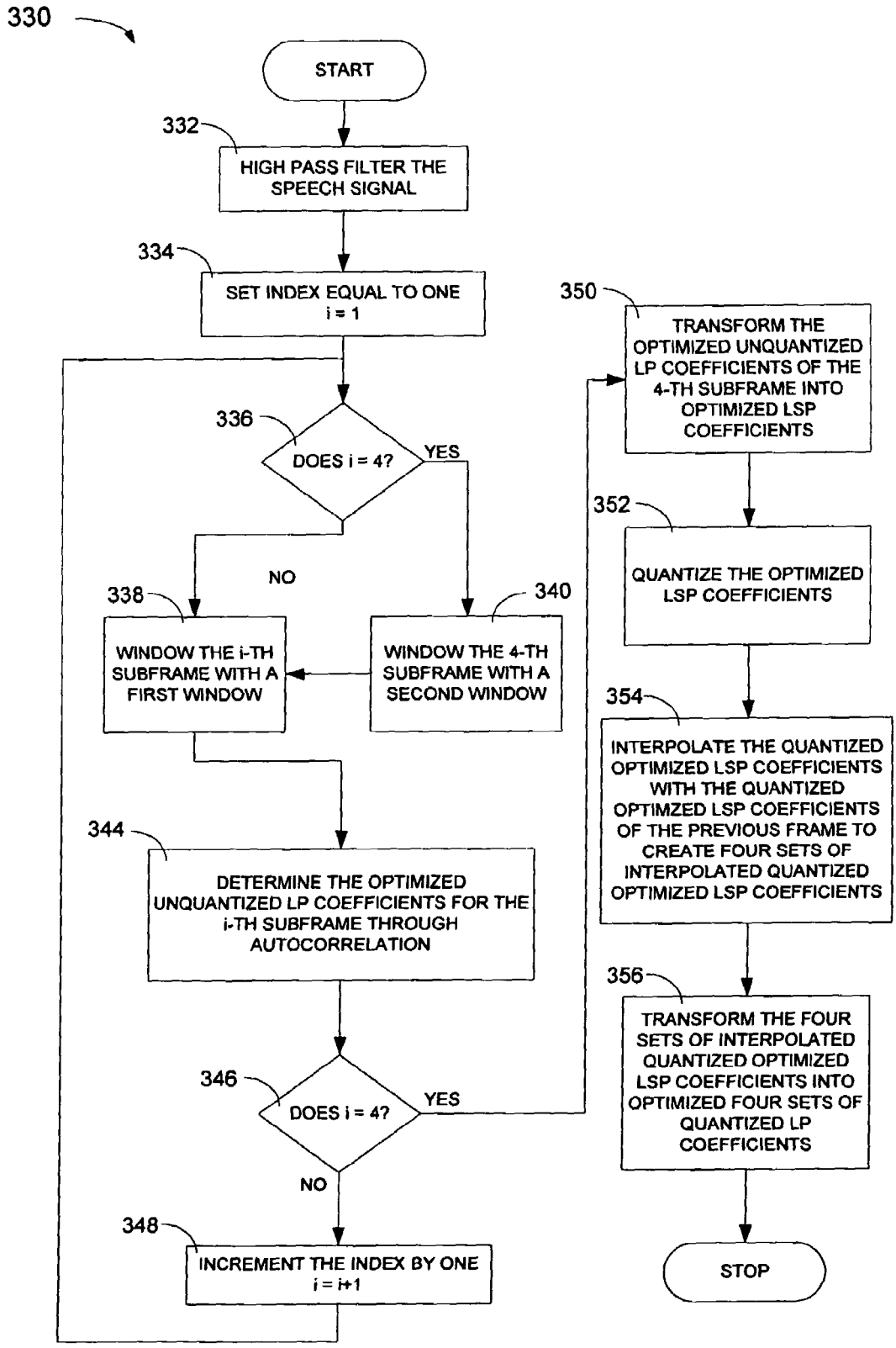
FIG. 14*b* is a flow chart of another embodiment of an improved linear predictive analysis for use in the G.723.1 speech coding standard.

The embodiments that include replacing the standard Hamming window with two windows are shown in FIGS. 14*a* and 14*b*.

Determining which optimization procedure should be used to create an optimized window depends on how the optimized window will be used, because the primary optimization procedure is only appropriate for creating windows that will be used for relatively simple calculations. Determining the LP coefficients involves computationally simple calculations. However, determining the quantized LP coefficients involves relatively complex calculations such as LSP transformation and interpolation. Therefore, the primary optimization procedure and the alternate optimization procedure can be used to optimize a window for instances where the optimized window will be the only window used or the first window used in determining unquantized LP coefficients. However, the alternate optimization procedure cannot be used to optimize a window if the resulting optimized window will be used to generate unquantized LP coefficients used to determine the quantized LP coefficients. Therefore, in the G.723.1 standard, if the Hamming window is replaced by a single optimized window, the single optimized window may be created using either the primary or alternate optimization procedures. Likewise, if the Hamming window is replace by two windows, the first window can be an optimized window determined by either optimization procedure. However, the second window can only be an optimized window created using the alternate optimization procedure.

Improving the G.723.1 standard by replacing the standard Hamming window with a single optimized window can be easily implemented and results in a process similar to that of the known G.723.1 standard, as shown in FIG. 1. However, during step 14, the i-th subframe of the filtered speech signal is filtered with an optimized window and not the standard Hamming window. In step 18, the optimized windowed i-th subframe is used to determine the optimized unquantized LP coefficients for that subframe. When the index equals four, during step 20, the optimized unquantized LP coefficients are to determine optimized quantized LP coefficients in steps 24, 26, 28 and 30. The entire process may be repeated for each frame of the speech signal or any number of frames as desired.

Determining the optimized quantized LP coefficients generally follows the same procedure as shown in FIG. 1 except, that in step 316 it is the optimized unquantized LP coefficients for the fourth subframe are transformed into optimized LSP coefficients. The optimized LSP coefficients are then quantized to create quantized optimized LSP coefficients 318. The quantized optimized LSP coefficients are interpolated with the quantized optimized LSP coefficients of the last frame to create four sets of interpolated quantized optimized LSP coefficients 320. Finally, the four sets of interpolated quantized optimized LSP coefficients are transformed into four sets of optimized quantized LSP coefficients, wherein each set corresponds to one of the subframes of the speech signal 322.

Although, in the embodiment 300 shown in FIG. 14*a*, each subframe of each frame is subjected to steps 306 and 301 in series, all the subframes in a given frame may first be windowed by the optimized window and then used to determine the optimized LP coefficients for each subframe. When the index equals four, the G.723.1 standard continues with a process for determining the optimized quantized LP coefficients.

Another embodiment of an improved G.723.1 standard is shown in FIG. 14*a* and indicated by reference number 370. This embodiment generally includes: high pass filtering the speech signal 372, setting an index "i" equal to one 374; determining whether i=4 376, wherein if the index does not equal 4, windowing the i-th subframe with an optimized first window 378 to create a first, second or third windowed subframe and if the index does equal 4, windowing the fourth subframe with a second window 380 to create a fourth windowed subframe; determining the optimized unquantized LP coefficients for the i-th subframe using 384; determining if i=4 386, wherein if the index does not equal four, incrementing the index so that i=i+1 388, reperforming steps 376, 378 or 380 (as appropriate), 384 and 386, repeating steps 388, 376, 378 or 380 (as appropriate), 384 and 386 until the index does equal four; when the index equals four, transforming the optimized unquantized LP coefficients of the fourth subframe into LSP coefficients 390, quantizing the optimized LSP coefficients 392; interpolating the quantized optimized LSP coefficients with the corresponding quantized optimized LSP coefficients of the previous frame to create four sets of interpolated quantized optimized LSP coefficients 394; and transforming the four sets of interpolated quantized optimized LSP coefficients into four sets of optimized quantized LP coefficients 396.

High pass filtering the speech signal 372 generally includes removing the DC component of the speech signal to create a filtered speech signal as it did in the embodiment shown in FIG. 14*a*. Either the filtered speech signal or the speech signal is then subject to another embodiment of the improved LPA process of the improved G.723.1 standard which generally includes steps 374, 376, 378, 380, 384, 386 and 388. In this improved LPA process, the standard Hamming window is replaced with two windows: a first window which is generally an optimized first window and a second window.

The optimized first window may be created using either the primary or alternate optimization procedures. If the optimized first window was created using the primary optimization procedure, the second window can be either a Hamming window or an optimized second window created using the alternate optimization procedure. Alternatively, if the optimized first window was created using the alternate optimization procedure, the second window can be a Hamming window. The optimized first window is used to window the first, second and third filtered subframes of the frames of the speech signal in step 378 to create first, second and third windowed subframes. The second window is used to window the fourth subframe of the speech signal in step 380 to create a fourth windowed subframe. The first, second, third and fourth windowed subframes are then used to determine the optimized unquantized LP coefficients for each subframe as described herein in step 384.

In the manner described previously herein in connection with the embodiment replacing the standard Hamming window with a single optimized window, each subframe of each frame is subjected to steps 378 and 384 in series or, alternately, to steps 380 and 384 in series. This is accomplished by initially setting an index "i" equal to one in step 374 to represent the first subframe in a given frame, and increasing the index by one in step 388 after it has been determined that the index does not equal four in step 386, indicating the end of a frame. Alternately, all the subframes in a given frame may first be windowed by the appropriate window and then used to determine the optimized LP coefficients for each subframe in the window.

When the index equals four, the optimized quantized LP coefficients are determined using the unquantized LP coefficients of the fourth subframe as generally embodied by steps 390, 392, 394 and 396. Steps 390, 392, 394 and 396 are generally equivalent to the following steps in FIG. 1: 24, 26, 28 and 30, respectively, except as discussed previously herein in connection with the embodiments replacing the standard Hamming window with a single optimized window.

Another embodiment of an improved G.723.1 standard is shown in FIG. 14*b* and indicated by reference number 330. This embodiment generally includes: high pass filtering the speech signal 332, setting an index "i" equal to one 334; determining whether i=4 336 wherein if the index does not equal 4, windowing the i-th subframe with a first window 338 to create a first, second or third windowed subframe, and if the index does equal 4 windowing the fourth subframe with a second window 380 to create a fourth windowed subframe, and windowing the fourth subframe with the first window 338 to create an additional fourth windowed subframe; determining the optimized unquantized LP coefficients for the i-th subframe using the first, second, third and fourth windowed subframes, and determining a second set of optimized unquantized LP coefficients using the additional fourth windowed subframe 344; determining if i=4 346, wherein if the index does not equal four, incrementing the index so that i=i+1 348, reperforming steps 336, 338 and/or 340 (as appropriate), 344 and 346, and repeating steps 348, 338 and/or 340 (as appropriate), 344 and 346 until the index does equal four; when the index equals four, transforming the optimized unquantized LP coefficients of the additional fourth subframe into LSP coefficients 350, quantizing the optimized LSP coefficients 352; interpolating the quantized optimized LSP coefficients with the corresponding quantized optimized LSP coefficients of the previous frame to create four sets of interpolated quantized optimized LSP coefficients 354; and transforming the four sets of interpolated quantized optimized LSP coefficients into four sets of optimized quantized LP coefficients 356.

High pass filtering the speech signal 332 generally includes removing the DC component of the speech signal to create a filtered speech signal as it did in the embodiments shown in FIGS. 1 and 14*a*. Either the filtered speech signal or the speech signal is then subject to another embodiment of the improved LPA process of the improved G.723.1 standard which generally includes steps 334, 336, 338, 340, 344, 346 and 348. In this improved LPA process, the standard Hamming window is replaced with two windows: a first window and a second window. The first window is generally either an optimized first window created using the primary optimization procedure or a Hamming window. If the first window is an optimized first window, the second window can either be a Hamming window or an optimized second window created using the alternate optimization procedure. If the first window is a Hamming window, the second window is an optimized second window generated by the alternate optimization procedure. The first window is used to window the first, second, third and fourth filtered subframes of the frames of the speech signal in step 338 to create first, second, third and fourth windowed subframes. The second window is used to again window the fourth subframe of the speech signal in step 380 to create an additional fourth windowed subframe. The first, second, third and fourth windowed subframes are then used to determine first optimized unquantized LP coefficients for each subframe using the autocorrelation method, as described herein, in step 344. The additional fourth windowed subframe is used to determine second optimized unquantized LP coefficients using autocorrelation method. This requires that the autocorrelation method be performed one additional time as compared to the known G.723.1 standard.

Similar to the embodiments 300 and 370 shown in FIGS. 1 and 14*a*, respectively, each subframe of each frame is subjected to steps 338 and 344 in series or, alternately, to steps 340, 338 and 344 in series. This is accomplished by initially setting an index "i" equal to one in step 334 to represent the first subframe in a given frame, and increasing the index by one in step 348 after it has been determined that the index does not equal four in step 346, indicating the end of a frame. Alternately, all the subframes in a given frame may first be windowed by the appropriate window and then used to determine the optimized LP coefficients for each subframe in the window.

When the index equals four, the G.723.1 standard determines the optimized quantized LP coefficients. Determining the optimized quantized LP coefficients is generally embodied by steps 350, 352, 354 and 356 and generally equivalent to the following steps in FIG. 14*a*: 390, 392, 394 and 396, respectively, except that it is the second optimized unquantized LP coefficients that are used to determine the four sets of quantized LP coefficients.

Figure 15A:
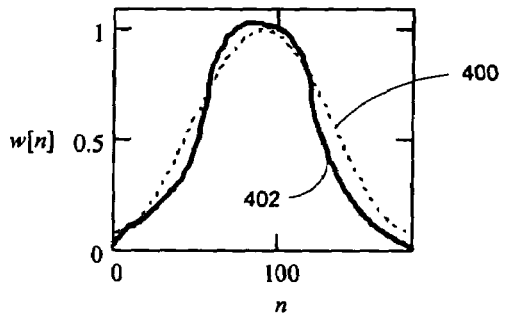
FIG. 15*a* is a plot of a Hamming window and one embodiment of an optimized window for perceptual weighting.
Figure 15B:
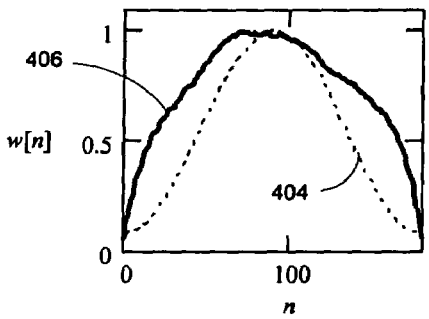
FIG. 15*b* is a Hamming window and one embodiment of an optimized window for synthesis filtering.

Optimized windows have been developed using the primary and alternate optimization procedures and are shown in FIG. 15*a* and FIG. 15*b*. The training data set used to create these windows was created using 54 files from the TIMIT database downsampled to 8 kHz with a total duration of approximately three minutes. Both the primary and alternate optimization procedures are used to optimize the Hamming window of the G.723.1 standard by using the Hamming window as the initial window.

FIG. 15*a* shows the standard Hamming window 400 and the optimized window created by the primary optimization procedure 402 for the purpose of creating a perceptual weighting filter. The optimized window created by the primary optimization procedure ("w1") 402 demonstrates an average increase of 1% in SPG over the Hamming window 400. Sample values of w1, for n=0 to 179 are given below:

w1[n]={0.116678, 0.187803, 0.247690, 0.277898, 0.350155, 0.403122, 0.459569, 0.477158, 0.550173, 0.602804, 0.622396, 0.565438, 0.578363, 0.609173, 0.650848, 0.662152, 0.699226, 0.727282, 0.758316, 0.793326, 0.825134, 0.855233, 0.886145, 0.937144, 0.972893, 1.011895, 1.049858, 1.081863, 1.136440, 1.184239, 1.213611, 1.248354, 1.297161, 1.348743, 1.399985, 1.436935, 1.469402, 1.530092, 1.570877, 1.624311, 1.684477, 1.761751, 1.830493, 1.899967, 1.969700, 2.052247, 2.129914, 2.214113, 2.340677, 2.483695, 2.621665, 2.772540, 2.920029, 3.092630, 3.286933, 3.494883, 3.699867, 3.948207, 4.201077, 4.437648, 4.528047, 4.629731, 4.670350, 4.732200, 4.807459, 4.869654, 4.955823, 5.042287, 5.118107, 5.156739, 5.196275, 5.227170, 5.263733, 5.299689, 5.331259, 5.353726, 5.366344, 5.380354, 5.397437, 5.405898, 5.409608, 5.420908, 5.427468, 5.442414, 5.436848, 5.435011, 5.425997, 5.421427, 5.419302, 5.413182, 5.392979, 5.368519, 5.359407, 5.354677, 5.359883, 5.352392, 5.335619, 5.322016, 5.309566, 5.296920, 5.269704, 5.251029, 5.232569, 5.210761, 5.170894, 5.131525, 5.084129, 5.009702, 4.951736, 4.892913, 4.829910, 4.759048, 4.687846, 4.610099, 4.528398, 4.419788, 4.288011, 4.124828, 3.901250, 3.628421, 3.362433, 3.129397, 3.015737, 2.918085, 2.827448, 2.686114, 2.560415, 2.454908, 2.344123, 2.241013, 2.114635, 2.047803, 1.964048, 1.892729, 1.792203, 1.697485, 1.650110, 1.571169, 1.458792, 1.407726, 1.363763, 1.310565, 1.235393, 1.192798, 1.151590, 1.112173, 1.042805, 0.996241, 0.943765, 0.911775, 0.861747, 0.825462, 0.769422, 0.734885, 0.677630, 0.661209, 0.618541, 0.587957, 0.543497, 0.520713, 0.484823, 0.459620, 0.435362, 0.403478, 0.368413, 0.344200, 0.323539, 0.296270, 0.268920, 0.248246, 0.220681, 0.206877, 0.192833, 0.173539, 0.150747, 0.132167, 0.110015, 0.091688, 0.067250, 0.032262};

FIG. 15*b* shows the standard Hamming window 404 and the optimized window created by using the alternate optimization procedure 406 for the purpose of creating a synthesis filter. The optimized window created by the alternate optimization procedure ("w2") 402 demonstrates an average increase of 0.4% in SPG over the Hamming window. Sample values of w2, for n=0 to 179 are given below:

w2[n]={0.056150, 0.122093, 0.153056, 0.194804, 0.232918, 0.256735, 0.288945, 0.321137, 0.348886, 0.369576, 0.398987, 0.417789, 0.441931, 0.458774, 0.473394, 0.496449, 0.519846, 0.531719, 0.537380, 0.547242, 0.560622, 0.573669, 0.589379, 0.601614, 0.607865, 0.623282, 0.637267, 0.643013, 0.648370, 0.651969, 0.659885, 0.672638, 0.682769, 0.695845, 0.713788, 0.726714, 0.733964, 0.737232, 0.745326, 0.751638, 0.756986, 0.760639, 0.773152, 0.785181, 0.808572, 0.812042, 0.817217, 0.829137, 0.846258, 0.860442, 0.859832, 0.868616, 0.878803, 0.892221, 0.902228, 0.909677, 0.916959, 0.932141, 0.936339, 0.946345, 0.955946, 0.959545, 0.961508, 0.970389, 0.975104, 0.986054, 0.977306, 0.976722, 0.991886, 0.998282, 0.997183, 0.995679, 0.991806, 0.992466, 0.990864, 0.987734, 0.986736, 0.995052, 0.990209, 0.988615, 0.986234, 0.985936, 0.993675, 0.995970, 0.987970, 0.990797, 0.987486, 0.980312, 0.979255, 0.978351, 0.974572, 0.979379, 0.988165, 0.993288, 0.985317, 0.980782, 0.971883, 0.973339, 0.969808, 0.963645, 0.957974, 0.959252, 0.957285, 0.952720, 0.947759, 0.943038, 0.936762, 0.933639, 0.928044, 0.928150, 0.924647, 0.910499, 0.901902, 0.900863, 0.900764, 0.891760, 0.877730, 0.866695, 0.860050, 0.850889, 0.843083, 0.833563, 0.824455, 0.818162, 0.813551, 0.814092, 0.805367, 0.802510, 0.803210, 0.797523, 0.792023, 0.785907, 0.781184, 0.772191, 0.775102, 0.764332, 0.763737, 0.756556, 0.754807, 0.742855, 0.733913, 0.727639, 0.722874, 0.719140, 0.710869, 0.703657, 0.699092, 0.687752, 0.680553, 0.676326, 0.666102, 0.652782, 0.648256, 0.645045, 0.638322, 0.630853, 0.624358, 0.615732, 0.604071, 0.593158, 0.574702, 0.562575, 0.550668, 0.538416, 0.525374, 0.504568, 0.486167, 0.467762, 0.449641, 0.423078, 0.403092, 0.371439, 0.354919, 0.325713, 0.292780, 0.255803, 0.214365, 0.169719, 0.118185, 0.056853};

Regardless of whether the optimized window was created using the primary or the alternate optimization procedure, any window with samples that are approximately within a distance d=0.0001 of the optimized window (either w1 or w2) will yield comparable results and thus will also be considered an optimized window. However, even more optimal results will be produced if a window with samples that is approximately within a distance d=0.00001 of the optimized window (either w1 or w2) are used. For the purpose of determining which windows yield comparable results, the distance between two windows d(wa,wb) is defined according to the following equation:

$$d(wa, wb) = \sum_{n=0}^{N-1} \left( \frac{wa[n]}{\sqrt{\sum_{k=0}^{N-1} wa^2[k]}} - \frac{wb[n]}{\sqrt{\sum_{k=0}^{N-1} wb^2[k]}} \right)^2 \quad (29)$$

Wherein wa equals w1 or w2, n and k are sample indices and, the number of samples N equals 180.

To assess the improvement in subjective quality achieved by replacing the Hamming window used by the known G.723.1 standard with an optimized window created with either the primary or alternate optimization procedures, the PESQ scores for a variety of speech coding systems using a variety of window combinations were determined. PESQ scores are a measure of subjective quality that are set forth in the recent ITU-T P.862 perceptual evaluation of speech quality (PESQ) standard (as described in ITU, "Perceptual Evaluation of Speech Quality (PESQ), An Objective Method for End-to-End Speech Quality Assessment of Narrow-Band Telephone Networks and Speech Codecs—ITU-T Recommendation P.862," Pre-publication, 2001; and Opticom, OPERA: "Your Digital Ear!—User Manual, Version 3.0, 2001"). Five speech coding systems were implemented for comparison, with the differences among them being the particular LPA used, specifically, the windows used and number of times a determination of unquantized LP coefficients was made. The speech coding systems included:

Coder 1: The G.723.1 standard according to the standard specifications, wherein only one set of unquantized LP coefficients are calculated using a Hamming window;

Coder 2: The G.723.1 speech coding system modified so that two sets of unquantized LP coefficients were calculated, wherein the first set of unquantized LP coefficients were calculated for all four subframes with w1 (the optimized window created using the primary optimization procedure), and the second set of unquantized LP coefficients were calculated for the last subframe only using a Hamming window;

Coder 3: The G.723.1 speech coding system modified so that two sets of unquantized LP coefficients were calculated, wherein the first set of unquantized LP coefficients were calculated for all four subframes with a Hamming window and the second set of unquantized LP coefficients were calculated for the last subframe only with w2 (the optimized window created using the alternate optimization procedure);

Coder 4: The G.723.1 speech coding system modified so that two sets of unquantized LP coefficients were calculated, wherein the first set of unquantized LP coefficients were calculated for all four subframes with w1, and the second set of unquantized LP coefficients were calculated for the last subframe only with w2; and Coder 5: The G.723.1 speech coding system modified so that two sets of unquantized LP coefficients were calculated, wherein the first set of unquantized LP coefficients were calculated for the first three subframes with w1 and for the last subframe with w2, and the second set of unquantized LP coefficients were calculated for the last subframe only with w2.

To evaluate the capability of the optimized windows to work for signals outside the training data set, a testing data set was formed using 6 files which were not included in the training data set which made the total duration of the testing data set approximately 8.4 seconds.

The table shown in FIG. 16 summarizes the PESQ scores for Coders 1-5. These PESQ scores indicate that the incorporation of optimized windows into the LPA process improves the subjective quality of the synthesized speech signal. Coder 4 is the best performer for the training data set, with Coder 5 as a close second. The incorporation of the second optimized window w2 provides the largest increase in subjective performance, as can be seen by a comparison of the results for the coders that use w2 (Coders 3, 4, & 5) to the results of the coders that did not use w2 (Coders 1 and 2). The results also indicate that the increase in subjective quality can be generalized to data outside the training set because the PESQ scores for the testing data set approach those of the corresponding training data set.

The table shown in FIG. 17 shows additional PESQ scores for eight sentences extracted from the DoCoMo Japanese speech database; these sentences are not contained in the training data set and have a total duration of 41 seconds. The greatest improvements in PESQ score are observed for Coders 4 and 5 which used both the first optimized window and the second optimized window.

Figure 18:
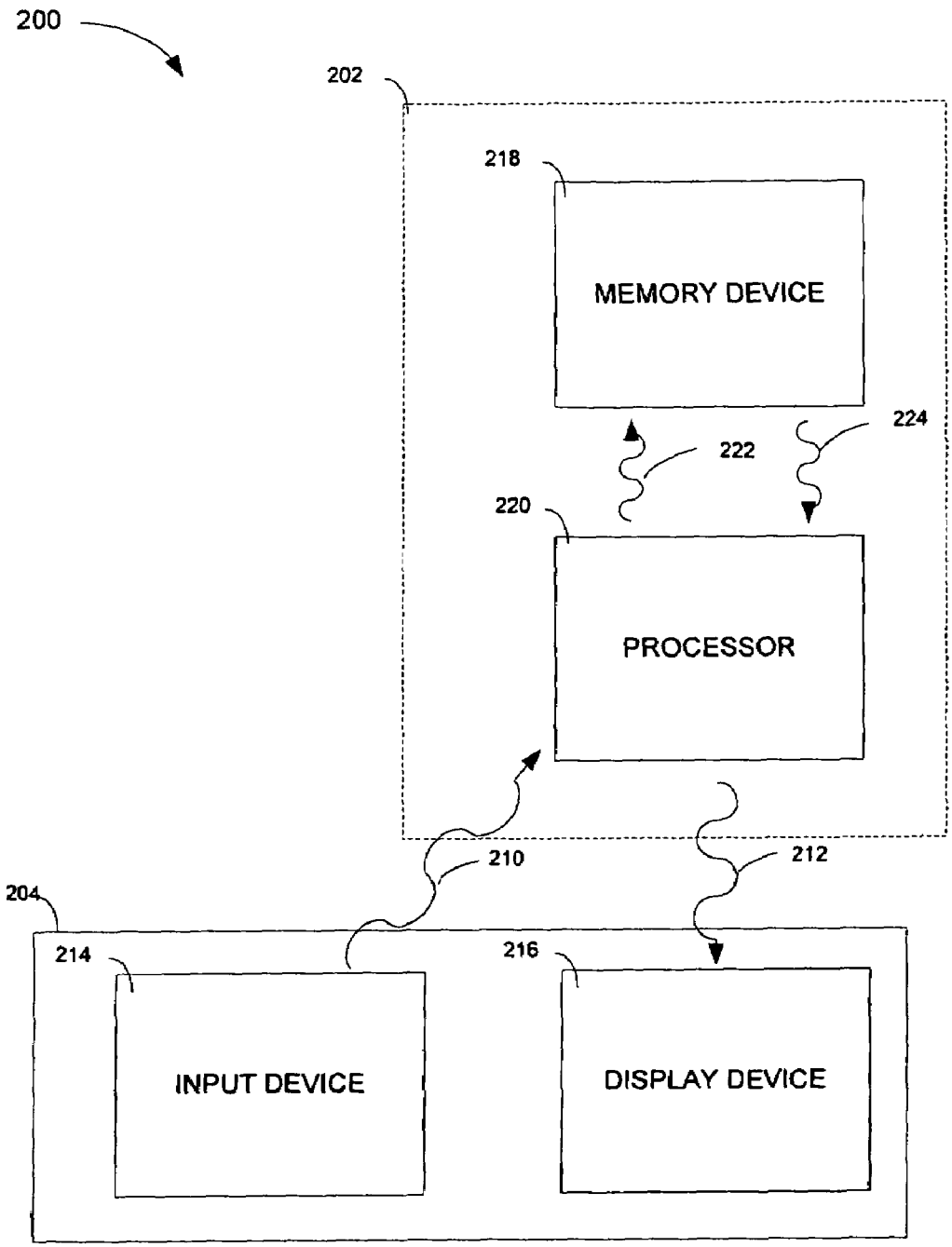
FIG. 18 is a block diagram of one embodiment of a window optimization device.

The window optimization algorithms may be implemented in a window optimization device as shown in FIG. 18 and indicated as reference number 200. The optimization device 200 generally includes a window optimization unit 202 and may also include an interface unit 204. The optimization unit 202 includes a processor 220 coupled to a memory device 216. The memory device 216 may be any type of fixed or removable digital storage device and (if needed) a device for reading the digital storage device including, floppy disks and floppy drives, CD-ROM disks and drives, optical disks and drives, hard-drives, RAM, ROM and other such devices for storing digital information. The processor 220 may be any type of apparatus used to process digital information. The memory device 216 stores, the speech signal, at least one of the window optimization procedures, and the known derivatives of the autocorrelation values. Upon the relevant request from the processor 220 via a processor signal 222, the memory communicates one of the window optimization procedures, the speech signal, and/or the known derivatives of the autocorrelation values via a memory signal 224 to the processor 220. The processor 220 then performs the optimization procedure.

The interface unit 204 generally includes an input device 214 and an output device 216. The output device 216 is any type of visual, manual, audio, electronic or electromagnetic device capable of communicating information from a processor or memory to a person or other processor or memory. Examples of display devices include, but are not limited to, monitors, speakers, liquid crystal displays, networks, buses, and interfaces. The input device 14 is any type of visual, manual, mechanical, audio, electronic, or electromagnetic device capable of communicating information from a person or processor or memory to a processor or memory. Examples of input devices include keyboards, microphones, voice recognition systems, trackballs, mice, networks, buses, and interfaces. Alternatively, the input and output devices 214 and 216, respectively, may be included in a single device such as a touch screen, computer, processor or memory coupled to the processor via a network. The speech signal may be communicated to the memory device 216 from the input device 214 through the processor 220. Additionally, the optimized window may be communicated from the processor 220 to the display device 212.

Although the methods and apparatuses disclosed herein have been described in terms of specific embodiments and applications, persons skilled in the art can, in light of this teaching, generate additional embodiments without exceeding the scope or departing from the spirit of the claimed invention.

I claim:

1. An improved linear predictive analysis procedure for an ITU-T G.723.1 speech coding system, comprising:

windowing, with a window optimization device, the first, second, third and fourth subframes of each frame of a speech signal with an optimized window to create first, second, third and fourth windowed subframes of each frame, the optimized window determined by using a primary optimization procedure;

determining optimized unquantized linear predictive analysis coefficients for each subframe from the first, second, third and fourth windowed subframes using an autocorrelation method; and determining optimized quantized linear predictive coefficients using the optimized unquantized linear predictive analysis coefficients for the fourth subframe.

2. The improved linear predictive analysis procedure, as claimed in claim 1, wherein the optimized window is determined using an alternate optimization procedure that is different from the primary optimization procedure.

3. The improved linear predictive analysis procedure, as claimed in claim 2, wherein the optimized window comprises a plurality of sample values w2.

4. The improved linear predictive analysis procedure, as claimed in claim 2, wherein the optimized window comprises a first plurality of sample values wa, wherein the first plurality of sample values are approximately within a distance d=0.0001 of a window comprising a second plurality of sample values wb, wb comprises w2; and wherein the distance d between wa and wb is defined according to a number of samples N, a first index n, a second index k, and according to an equation:

$$d(wa, wb) = \sum_{n=0}^{N-1} \left( \frac{wa[n]}{\sqrt{\sum_{k=0}^{N-1} wa^2[k]}} - \frac{wb[n]}{\sqrt{\sum_{k=0}^{N-1} wb^2[k]}} \right)^2.$$

5. The method for improving an ITU-T G.723.1 standard, as claimed in claim 4, wherein the first plurality of sample values are approximately within a distance d=0.00001 of the window comprising the second plurality of sample values wb.

6. An improved linear predictive analysis procedure for an ITU-T G.723.1 speech coding system, comprising:

the steps of claims 1, 2, 3, 4, or 5; and determining, with a window optimization device, optimized quantized linear predictive coefficients using the optimized unquantized linear predictive analysis coefficients for the fourth subframe.

7. An improved linear predictive analysis procedure for an ITU-T G.723.1 speech coding system, comprising:

windowing, with a window optimization device, a first, second, and third subframes of each frame of a speech signal with a first window to create a first, second and third windowed subframes for each frame, the first window created by using a primary optimization procedure;

windowing a fourth subframe of each frame of the speech signal with a second window to create a fourth windowed subframe for each frame, wherein the second window does not equal the first window;

determining the optimized unquantized linear predictive analysis coefficients for the first, second, third and fourth subframes for each frame from the first, second, third and fourth windowed subframes using an autocorrelation method; and determining optimized quantized linear predictive coefficients using the optimized unquantized linear predictive analysis coefficients for the fourth subframe.

8. The improved linear predictive analysis procedure, as claimed in claim 7, wherein the first window comprises an optimized first window created by a primary optimization procedure.

9. The improved linear predictive analysis procedure, as claimed in claim 8, wherein the optimized first window comprises a plurality of sample values w1.

10. The improved linear predictive analysis procedure, as claimed in claim 8, wherein the optimized second window comprises a first plurality of sample values wa, wherein the first plurality of sample values are approximately within a distance d=0.0001 of a window comprising a second plurality of sample values wb, wherein wb comprises w1; and wherein the distance d between wa and wb is defined according to a number of samples N, a first index n, a second index k, and according to an equation:

$$d(wa, wb) = \sum_{n=0}^{N-1}\left(\frac{wa[n]}{\sqrt{\sum_{k=0}^{N-1} wa^2[k]}} - \frac{wb[n]}{\sqrt{\sum_{k=0}^{N-1} wb^2[k]}}\right)^2.$$

11. The improved linear predictive analysis procedure, as claimed in claim 10, wherein the first plurality of sample values are approximately within a distance d=0.00001 of the window comprising the second plurality of sample values wb.

12. The improved linear predictive analysis procedure, as claimed in claim 8, wherein the third window is a Hamming window.

13. The improved linear predictive analysis procedure, as claimed in claim 7, wherein the third window is an optimized third window created by an alternate optimization procedure that is different from the primary optimization procedure.

14. The improved linear predictive analysis procedure, as claimed in claim 13, wherein the optimized third window comprises a plurality of sample values w2.

15. The improved linear predictive analysis procedure, as claimed in claim 13, wherein the optimized third window comprises a first plurality of sample values wa, wherein the first plurality of sample values are approximately within a distance d=0.0001 of a window comprising a second plurality of sample values wb, wherein wb comprises w2; and wherein the distance d between wa and wb is defined according to a number of samples N, a first index n, a second index k, and according to an equation:

$$d(wa, wb) = \sum_{n=0}^{N-1}\left(\frac{wa[n]}{\sqrt{\sum_{k=0}^{N-1} wa^2[k]}} - \frac{wb[n]}{\sqrt{\sum_{k=0}^{N-1} wb^2[k]}}\right)^2.$$

16. The improved linear predictive analysis procedure, as claimed in claim 15, wherein the first plurality of sample values are approximately within a distance d=0.00001 of the window comprising the second plurality of sample values wb.

17. The improved linear predictive analysis procedure as claimed in claim 7, wherein the first window comprises an optimized first window created by an alternate optimization procedure that is different from the primary optimization procedure.

18. The improved linear predictive analysis procedure as claimed in claim 17, wherein the first optimized window comprises a plurality of sample values w2.

19. The improved linear predictive analysis procedure as claimed in claim 17, wherein the first optimized window comprises a first plurality of sample values wa, wherein the first plurality of sample values are approximately within a distance d=0.0001 of a window comprising a second plurality of sample values wb, wherein wb comprises w2; and wherein the distance d between wa and wb is defined according to a number of samples N, a first index n, a second index k, and according to an equation:

$$d(wa, wb) = \sum_{n=0}^{N-1}\left(\frac{wa[n]}{\sqrt{\sum_{k=0}^{N-1} wa^2[k]}} - \frac{wb[n]}{\sqrt{\sum_{k=0}^{N-1} wb^2[k]}}\right)^2.$$

20. The improved linear predictive analysis procedure, as claimed in claim 19, wherein the first plurality of sample values are approximately within a distance d=0.00001 of the window comprising the second plurality of sample values wb.

21. The improved linear predictive analysis procedure as claimed in claim 17, wherein the third window comprises a Hamming window.

22. An improved linear predictive analysis procedure for an ITU-T G.723.1 speech coding system, comprising:

the steps of claims 4, 5, 7, 8, 9, 10, 11, 12, 13, 14, 15, 16, 17, 18, 19, 20, or 21; and determining, with a window optimization device, optimized quantized linear predictive coefficients using the optimized unquantized linear predictive analysis coefficients for the fourth subframe.

23. An improved linear predictive analysis procedure for an ITU-T G.723.1 speech coding system, comprising:

windowing, with a window optimization device, a first, second, third and fourth subframes of each frame of a speech signal with a first window to create a first, second, third and fourth windowed subframe for each frame;

windowing the fourth subframe of each frame of the speech signal with a second window to create an additional fourth windowed subframe for each frame, wherein the second window does not equal the first window;

determining optimized unquantized linear predictive analysis coefficients for the first, second, third and fourth subframes for each frame from the first, second, third and fourth windowed subframes using an autocorrelation method; and determining optimized unquantized linear predictive coefficients for the additional fourth windowed subframe using an autocorrelation method.

24. The improved linear predictive analysis procedure, as claimed in claim 23, wherein the first window is an optimized first window created by a primary optimization procedure.

25. The improved linear predictive analysis procedure, as claimed in claim 24, wherein the optimized first window comprises a plurality of sample values w1.

26. The improved linear predictive analysis procedure, as claimed in claim 24, wherein the optimized first window comprises a first plurality of sample values wa, wherein the first plurality of sample values are approximately within a distance d=0.0001 of a window comprising a second plurality of sample values wb, wherein wb comprises w1; and wherein the distance d between wa and wb is defined according to a number of samples N, a first index n, a second index k, and according to an equation:

$$d(wa, wb) = \sum_{n=0}^{N-1} \left( \frac{wa[n]}{\sqrt{\sum_{k=0}^{N-1} wa^2[k]}} - \frac{wb[n]}{\sqrt{\sum_{k=0}^{N-1} wb^2[k]}} \right)^2.$$

27. The improved linear predictive analysis procedure, as claimed in claim 26, wherein the first plurality of sample values are approximately within a distance d=0.00001 of the window comprising the second plurality of sample values wb.

28. The improved linear predictive analysis procedure, as claimed in claim 24, wherein the second window is an optimized second window created by an alternate optimization procedure.

29. The improved linear predictive analysis procedure, as claimed in claim 28, wherein the optimized second window a plurality of sample values w1.

30. The improved linear predictive analysis procedure, as claimed in claim 28, wherein the optimized second window a first plurality of sample values wa, wherein the first plurality of sample values are approximately within a distance d=0.0001 of a window comprising a second plurality of sample values wb, wherein wb comprises w2; and wherein the distance d between wa and wb is defined according to a number of samples N, a first index n, a second index k, and according to an equation:

$$d(wa, wb) = \sum_{n=0}^{N-1} \left( \frac{wa[n]}{\sqrt{\sum_{k=0}^{N-1} wa^2[k]}} - \frac{wb[n]}{\sqrt{\sum_{k=0}^{N-1} wb^2[k]}} \right)^2.$$

31. The improved linear predictive analysis procedure, as claimed in claim 30, wherein the first plurality of sample values are approximately within a distance d=0.00001 of the window comprising the second plurality of sample values wb.

32. The improved linear predictive analysis procedure, as claimed in claim 24, wherein the second window comprises a Hamming window.

33. The improved linear predictive analysis procedure, as claimed in claim 23, wherein the first window comprises a Hamming window and the second window comprises an optimized second window created using an alternate optimization procedure.

34. The improved linear predictive analysis procedure, as claimed in claim 33, wherein the optimized second window comprises a plurality of sample values w2.

35. The improved linear predictive analysis procedure, as claimed in claim 33, wherein the optimized second window comprises a first plurality of sample values wa, wherein the first plurality of sample values are approximately within a distance d=0.0001 of a window comprising a second plurality of sample values wb, wherein wb comprises w2 ; and wherein the distance d between wa and wb is defined according to a number of samples N, a first index n, a second index k, and according to an equation:

$$d(wa, wb) = \sum_{n=0}^{N-1} \left( \frac{wa[n]}{\sqrt{\sum_{k=0}^{N-1} wa^2[k]}} - \frac{wb[n]}{\sqrt{\sum_{k=0}^{N-1} wb^2[k]}} \right)^2.$$

36. The improved linear predictive analysis procedure, as claimed in claim 35, wherein the first plurality of sample values are approximately within a distance d=0.0001 of the window comprising the second plurality of sample values wb.

37. An improved linear predictive analysis procedure for an ITU-T G.723.1 speech coding system, comprising:

the steps of claims 23, 24, 25, 26, 27, 28, 29, 30, 31, 32, 33, 34, 35 or 36; and determining, with a window optimization device, optimized quantized linear predictive coefficients using the optimized unquantized linear predictive analysis coefficients for the additional fourth subframe.

38. The improved linear predictive analysis procedure, as claimed in claim 26, wherein the first plurality of sample values are approximately within a distance d=0.00001 of the window comprising the second plurality of sample values wb.

39. The improved linear predictive analysis Procedure, as claimed in claim 30, wherein the first plurality of sample values are approximately within a distance d=0.0.0001 of the window comprising the second plurality of sample values wb.

40. The improved linear predictive analysis procedure, as claimed in claim 32, wherein the first plurality of sample values are approximately within a distance d=0.00001 of the window comprising the second plurality of sample values wb.

41. A computer readable storage medium storing computer readable program code for determining optimized unquantized linear predictive coefficients for an ITU-T G.723.1 speech coding system, the computer readable program code comprising:

data encoding an optimized window, the optimized window created by using a primary optimization procedure;

a computer code implementing an improved linear prediction analysis process in response to a speech signal comprising a plurality of frames wherein each frame comprises a first, second, third and fourth subframe, wherein the improved linear prediction analysis process determines first, second, third and fourth windowed subframes for each of the plurality of frames by windowing the first, second, third and fourth subframes for each frame with the optimized window; and the optimized unquantized linear predictive coefficients for the first, second, third and fourth subframes of each of the plurality of frames using the first, second third and fourth windowed subframes of each of the plurality of frames.

42. The computer readable storage medium, as claimed in claim 41, further storing computer readable program code for determining optimized quantized linear predictive coefficients for the ITU-T G.723.1 speech coding system, wherein the computer readable program code further comprises a computer code implementing a process for determining the optimized quantized linear predictive coefficients from the optimized unquantized linear predictive coefficients for the fourth subframe of each of the plurality of frames.

43. The computer readable storage medium, as claimed in claim 41, wherein the optimized window is created using an alternate optimization procedure that is different from the primary optimization procedure.

44. A computer readable storage medium storing computer readable program code for determining optimized unquantized linear predictive coefficients for an ITU-T G.723.1 speech coding system, the computer readable program code comprising:

data encoding an optimized first window and a second window, the optimized first window created by using a primary optimization procedure;

a computer code implementing an improved linear prediction analysis process in response to a speech signal comprising a plurality of frames and first, second, third and fourth subframes for each of the plurality of frames, wherein the improved linear predictive analysis process determines first, second and third windowed subframes for each of the plurality of frames by windowing the first, second and third subframes of each of the plurality of frames with the optimized first window; fourth windowed subframes for each of the plurality of frames by windowing the fourth subframe of each of the plurality of frames with the second window, and the optimized unquantized linear predictive coefficients for each of the plurality of frames using the first, second third and fourth windowed subframes of each of the plurality of frames.

45. The computer readable storage medium, as claimed in claim 44, further storing computer readable program code for determining optimized quantized linear predictive coefficients for the ITU-T G.723.1 speech coding system, wherein the computer readable program code further comprises a computer code implementing a process for determining the optimized quantized linear predictive coefficients from the optimized unquantized linear predictive coefficients for the fourth subframe of each of the plurality of frames.

46. The computer readable storage medium, as claimed in claim 44, wherein the optimized first window is created using a primary optimization procedure.

47. The computer readable storage medium, as claimed in claim 46, wherein the second window comprises a Hamming window.

48. The computer readable storage medium, as claimed in claim 46, wherein the second window is an optimized second window created using an alternate optimization procedure.

49. The computer readable storage medium, as claimed in claim 44, wherein the optimized first window is created using an alternate optimization procedure that is different than the primary optimization procedure.

50. The computer readable storage medium, as claimed in claim 49, wherein the second window comprises a Hamming window.

51. A computer readable storage medium storing computer readable program code for a method for determining optimized unquantized linear predictive coefficients for an ITU-T G.723.1 speech coding system, the computer readable program code comprising:

data encoding a first window and a second window, wherein the first window does not equal the second window;

a computer code implementing an improved linear prediction analysis process and a method for determining optimized unquantized linear predictive coefficients for an ITU-T G.723.1 speech coding system in response to a speech signal comprising a plurality of frames and first, second, third and fourth subframes for each of the plurality of frames, wherein the improved linear predictive analysis process determines first, second and third windowed subframes for each of the plurality of frames by windowing the first, second, third and fourth subframes of each of the plurality of frames with the first window; an additional fourth windowed sub frame for each of the plurality of frames by windowing the fourth subframe of each of the plurality of frames with the second window, and the optimized unquantized linear predictive coefficients for each of the plurality of frames using the first, second third and fourth windowed subframes of each of the plurality of frames; and wherein the computer readable program code further comprises a computer code implementing the process for determining the optimized quantized linear predictive coefficients from the optimized unquantized linear predictive coefficients for the additional fourth subframe of each of the plurality of frames.

52. The computer readable storage medium, as claimed in claim 41, wherein the first window is an optimized first window created using a primary optimization procedure and the second window comprises a Hamming window.

53. The computer readable storage medium, as claimed in claim 51, wherein the first window is an optimized first window created using a primary optimization procedure and the second window is an optimized second window created using an alternate optimization procedure.

* * * * *